US007153644B2

(12) United States Patent
Yokozawa et al.

(10) Patent No.: US 7,153,644 B2
(45) Date of Patent: Dec. 26, 2006

(54) SILVER HALIDE COLOR PHOTOSENSITIVE MATERIAL AND IMAGE FORMING METHOD

(75) Inventors: Akito Yokozawa, Minami-ashigara (JP); Tetsuo Nakamura, Minami-ashigara (JP); Katsuyuki Takada, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 221 days.

(21) Appl. No.: 10/842,536

(22) Filed: May 11, 2004

(65) Prior Publication Data

US 2005/0008982 A1 Jan. 13, 2005

(30) Foreign Application Priority Data

May 12, 2003 (JP) ..... 2003-133573

(51) Int. Cl.

| | |
|---|---|
| ***G03C 1/005*** | (2006.01) |
| ***G03C 1/494*** | (2006.01) |
| ***G03C 5/18*** | (2006.01) |
| ***G03C 5/26*** | (2006.01) |

(52) U.S. Cl. ..... 430/567; 430/570; 430/576; 430/581; 430/448; 430/486; 430/390

(58) Field of Classification Search ..... 430/567, 430/570, 576, 581, 448, 486, 390
See application file for complete search history.

(56) References Cited

U.S. PATENT DOCUMENTS 5,395,742 A * 3/1995 Deguchi et al. ..... 430/486
5,462,847 A * 10/1995 Otani ..... 430/567
5,972,590 A * 10/1999 Friour et al. ..... 430/567

FOREIGN PATENT DOCUMENTS

JP 6-230501 8/1994
JP 6-329936 11/1994

OTHER PUBLICATIONS

J.F. Hamilton, et al.; "The Theory of the Photographic Process" ; Fourth Edition; 1977; Chapter 13, pp. 396-397; Macmillan Publishing Co., Inc., New York; Collier Macmillan Publishers, London.

* cited by examiner

*Primary Examiner*—Geraldine Letscher
(74) *Attorney, Agent, or Firm*—Sughrue Mion, PLLC

(57) ABSTRACT

A silver halide color photosensitive material, which has: at least each one layer of yellow-, magenta- and cyan-color-forming photosensitive silver halide emulsion layers on a reflective support, and at least one non-light-sensitive non-color-forming hydrophilic colloidal layer; wherein at least one of the photosensitive silver halide emulsion layers contains a silver halide emulsion containing 90 mol % or more of silver chloride, and a compound having a repetitive unit of formula (I) is contained:

Formula (I)

wherein $R_1$ is —OR, —SR or —N—R(—R'), where R and R' are a hydrogen atom, or an alkyl, aryl, aralkyl, cycloalkyl or heterocyclic group, or R and R' may form a saturated carbon ring or a heterocycle; $R_2$ and $R_3$ are a hydrogen atom or an alkyl group; $Y_1$ and $Y_2$ are a polymethylene, arylene or cycloalkylene group; Z is —O—, —$SO_2$— or —$CH_2$—; and m is 0 or 1.

11 Claims, No Drawings

SILVER HALIDE COLOR PHOTOSENSITIVE MATERIAL AND IMAGE FORMING METHOD

FIELD OF THE INVENTION

The present invention relates to a silver halide color photosensitive material and an image forming method using the same. In particular, the invention relates to a color photographic photosensitive material of high sensitivity and quality, and to an image forming method by which stains at white background is suppressed even after rapid photographic processing.

BACKGROUND OF THE INVENTION

In recent years, in a photographic processing services industry, photosensitive materials that can remarkably shorten the time required for an image-forming process including steps of exposure, processing, and drying and realize a high image quality have been demanded as means for improving productivity and services for users. To comply with this demand, for instance, new exposure systems have been developed and marketed (e.g., Frontier 350, trade name, manufactured by Fuji Photo Film Co., Ltd.). Those exposure systems shorten the period from exposure to the initiation of processing (referred to as a "latent-image time" in the art) to approximately 10 seconds and perform rapid processing in which a total processing time from exposure to completion of drying is approximately 4 minutes. In other words, those systems are excellent in shortening the time required for delivering photographic prints to customers after orders. By using those systems, therefore, the customers enjoy services of receiving the photographic prints within an hour or so after orders.

Furthermore, each of the systems (e.g., Frontier 350, above) is able to readily give a high quality print by utilizing information from a negative-film of taken photography to execute image processing. In addition, such a system is also suitably designed for print output of digital image recording media such as digital cameras which have become widely used. Therefore, the above systems are popularized at a high rate in the market.

In general, in the case of shortening the time of the processing step, it has been known that its white background portions of a print may be stained because of a colored ingredients such as a sensitizing dye in a light-sensitive material, which is likely to remain due to insufficient washout. As means for solving such a problem, in JP-A-06-230501 ("JP-A" means unexamined published Japanese patent application), there is disclosed the use of a sensitizing dye having an aromatic group as a substituent, where the aromatic group has a specific structure different from a phenyl group. However, it is insufficient to overcome the problem and, in some cases, an increase in fogging may be caused and stains at the white background portions of a print deteriorate. Compounds well known in the art as antifogging agents, such as those described in "The Theory of the Photographic Process", $4^{th}$ edition, pp. 396–387, 1977, written by T. H. James, are effective to prevent the generation of fogging in actuality but causing another problem of a considerable decrease in sensitivity. Furthermore, technologies for improving the remaining of color, such as the use of a water-soluble diaminostilbene-series fluorescent brightening agent and the use of a highly hydrophilic sensitizing dye (e.g., JP-A-06-329936), a method of facilitating the washout of a sensitizing dye by reducing a dry film thickness along with a swelled film thickness, and so on have been investigated in the art. However, they are not always satisfactory ones. Therefore, it has been desired to provide a technology that can give a print stable and high quality with a white background less subjected to staining (coloring) in the rapid photographic processing.

SUMMARY OF THE INVENTION

The present invention resides in a silver halide color photosensitive material, which comprises: at least one yellow-color-forming light-sensitive silver halide emulsion layer, at least one magenta-color-forming light-sensitive silver halide emulsion layer, and at least one cyan-color-forming light-sensitive silver halide emulsion layer on a reflective support; and at least one non-light-sensitive non-color-forming hydrophilic colloidal layer, wherein at least one of the light-sensitive silver halide emulsion layers contains a silver halide emulsion that contains 90 mol % or more of silver chloride; and a compound having a repetitive unit represented by the following formula (I) is contained:

Formula (I)

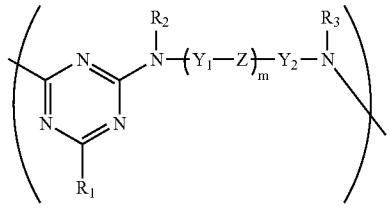

wherein $R_1$ represents —OR, —SR, or —N—R(—R'), in which R and R' each independently represent a hydrogen atom, or an alkyl group, an aryl group, an aralkyl group, a cycloalkyl group, or a heterocyclic group, which may be further substituted, and R and R' may bond together to form a saturated carbon ring or a heterocycle constructed of an alkylene group including —O—; $R_2$ and $R_3$ each independently represent a hydrogen atom or an alkyl group which may be further substituted; $Y_1$ and $Y_2$ each independently represent a polymethylene group, an arylene group, or a cycloalkylene group, which may be further substituted; Z represents —O—, —$SO_2$—, or —$CH_2$—; and m represents 0 (zero) or 1.

Further, the present invention resides in a method of forming a color image, which comprises, after exposure, subjecting the silver halide color photosensitive material to color development for 20 seconds or less.

Other and further features and advantages of the invention will appear more fully from the following description.

DETAILED DESCRIPTION OF THE INVENTION

According to the present invention, there can be provided the following means:

(1) A silver halide color photosensitive material, comprising:

at least one yellow-color-forming light-sensitive silver halide emulsion layer, at least one magenta-color-forming light-sensitive silver halide emulsion layer, and at least one cyan-color-forming light-sensitive silver halide emulsion layer on a reflective support; and at least one non-light-sensitive non-color-forming hydrophilic colloidal layer, wherein at least one of the photosensitive silver halide emulsion layers contains a silver halide emulsion that contains 90 mol % or more of silver chloride; and a compound having a repetitive unit represented by the following formula (I) is contained:

Formula (I):

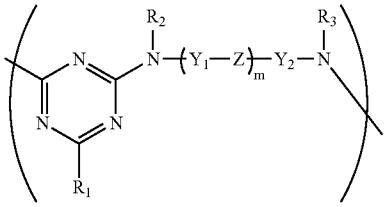

wherein $R_1$ represents —OR, —SR, or —N—R(—R'), in which R and R' each independently represent a hydrogen atom, or an alkyl group, an aryl group, an aralkyl group, a cycloalkyl group, or a heterocyclic group, which may be further substituted, or R and R' may bond together to form a saturated carbon ring or a heterocycle constructed of an alkylene group including —O—; $R_2$ and $R_3$ each independently represent a hydrogen atom or an alkyl group which may be further substituted; $Y_1$ and $Y_2$ each independently represent a polymethylene group, an arylene group, or a cycloalkylene group, which may be further substituted; Z represents —O—, —$SO_2$—, or —$CH_2$—; and m represents 0 (zero) or 1.

(2) The silver halide color photosensitive material as described in the item (1), in which the yellow-color-forming light-sensitive silver halide emulsion layer contains a silver halide emulsion which is spectrally sensitized by at least one sensitizing dye represented by the following formula (II):

Formula (II):

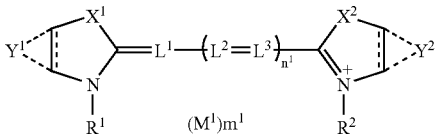

wherein $X^1$ and $X^2$ each independently represent an oxygen atom, a sulfur atom, a selenium atom, a tellurium atom, a nitrogen atom, or a carbon atom; $Y^1$ represents an atomic group necessary for forming a furan, pyrrole, thiophene, or benzene ring, which may be further condensed with another 5- or 6-membered carbon ring or heterocycle or may have a substituent; $Y^2$ represents an atomic group necessary for forming a benzene ring or a 5- or 6-membered unsaturated heterocycle, which may be further condensed with another 5- or 6-membered carbon ring or heterocycle or may have a substituent; a bond between two carbon atoms by which $Y^1$ and $Y^2$ are each condensed with the carbon ring or the heterocycle may be a single bond or a double bond; one of $R^1$ and $R^2$ represents an alkyl group substituted with an acidic group except a sulfo group and the other of $R^1$ and $R^2$ represents an alkyl group substituted with a sulfo group; $L^1$, $L^2$, and $L^3$ each independently represent a methine group; $n^1$ represents 0 (zero) or 1; $M^1$ represents a counter ion; and $m^1$ represents 0 (zero) or a larger number, which is necessary for neutralizing an electric charge in the molecule.

(3) The silver halide color photosensitive material as described in the item (2), in which the sensitizing dye represented by the formula (II) is represented by the following formula (III) or (IV):

Formula (III):

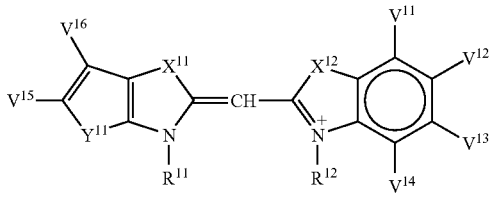

wherein $Y^{11}$ represents an oxygen atom, a sulfur atom, or N—$R^{13}$, in which $R^{13}$ represents a hydrogen atom or an alkyl group; $V^{15}$ and $V^{16}$ each independently represent a hydrogen atom or a substituent; $X^{11}$ and $X^{12}$ each independently represent an oxygen atom or a sulfur atom; one of $R^{11}$ and $R^{12}$ represents an alkyl group substituted with an acidic group except a sulfo group and the other of $R^{11}$ and $R^{12}$ represents an alkyl group substituted with a sulfo group; $V^{11}$, $V^{12}$, $V^{13}$, and $V^{14}$ each independently represent a hydrogen atom or a substituent; $M^{11}$ represents a counter ion; and $m^{11}$ represents 0 (zero) or a larger number, which is necessary for neutralizing an electric charge in the molecule;

Formula (IV):

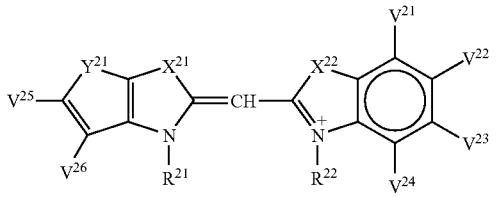

wherein $Y^{21}$ represents an oxygen atom, a sulfur atom, or N—$R^{23}$, in which $R^{23}$ represents a hydrogen atom or an alkyl group; $V^{25}$ and $V^{26}$ each independently represent a hydrogen atom or a substituent; $X^{21}$ and $X^{22}$ each independently represent an oxygen atom or a sulfur atom; one of $R^{21}$ and $R^{22}$ represents an alkyl group substituted with an acidic group except a sulfo group and the other of $R^{21}$ and $R^{22}$ represents an alkyl group substituted with a sulfo group; $V^{21}$, $V^{22}$, $V^{23}$, and $V^{24}$ each independently represent a hydrogen atom or a substituent; $M^{21}$ represents a counter ion; and $m^{21}$ represents 0 (zero) or a larger number, which is necessary for neutralizing an electric charge in the molecule.

(4) The silver halide color photosensitive material as described in the item (2), in which the sensitizing dye represented by the formula (II) is represented by the following formula (V):

Formula (V):

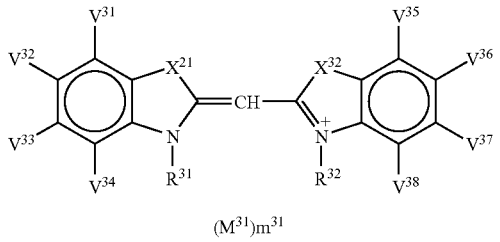

wherein $X^{31}$ and $X^{32}$ each independently represent an oxygen atom or a sulfur atom; one of $R^{31}$ and $R^{32}$ represents an alkyl group substituted with an acidic group except a sulfo group and the other of $R^{31}$ and $R^{32}$ represents an alkyl group substituted with a sulfo group; $V^{31}$, $V^{32}$, $V^{33}$, $V^{34}$, $V^{35}$, $V^{36}$, $V^{37}$, and $V^{38}$ each independently represent a hydrogen atom or a substituent, in which two adjacent substituents may bond together to form a condensed ring; $M^{31}$ represents a counter ion; and $m^{31}$ represents 0 (zero) or a larger number, which is necessary for neutralizing an electric charge in the molecule.

(5) The silver halide color photosensitive material as described in any one of the items (1) to (4), in which the silver halide emulsion contained in the yellow-color-forming light-sensitive silver halide emulsion layer contains silver iodide at a concentration of 0.02 to 0.5 mol %.

(6) The silver halide color photosensitive material as described in any one of the items (1) to (5), in which the silver halide emulsion contained in the yellow-color-forming light-sensitive silver halide emulsion layer is composed of crystal grains having a cubic or tetradecahedral structure having a cubic grain volume corresponding to 0.55 μm or less in side length.

(7) The silver halide color photosensitive material as described in any one of the items (1) to (6), in which the total amount of silver applied on photographic constituent layers is 0.2 g/$m^2$ or more and 0.46 g/$m^2$ or less.

(8) A method of forming a color image, comprising, after exposure, subjecting the silver halide color photosensitive material as described in any one of the items (1) to (7) to color development for 20 seconds or less.

Hereinbelow, the present invention will be described in detail.

The present invention pertains to a silver halide color photographic photosensitive material having a photosensitive silver halide layer and a non-photosensitive colloidal layer on a reflective support and to an image-forming method using such a material to allow reproduction of sufficient photographic performances and form an image having a negligible amount of color residue due to a sensitizing dye when ultra-quick processing from an exposure step to a drying step is conducted for approximately 1 minute.

At first, a compound having a repetitive unit represented by the following formula (I) used in the present invention will be described.

Formula (I):

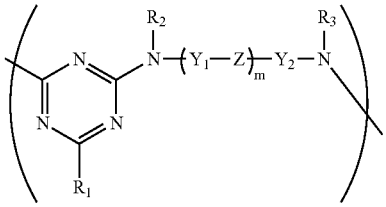

In the formula (I), $R_1$ represents —OR, —SR, or —N—R (—R'), in which R and R' each independently represent a hydrogen atom, or an alkyl group which may be substituted (preferably an alkyl group having 1 to 12 carbon atoms, more preferably an unsubstituted alkyl group, a hydroxyalkyl group, a sulfoalkyl group (or salts thereof), or a carboxyalkyl group (or salts thereof)), an aryl group which may be substituted (preferably an aryl group having 6 to 12 carbon atoms, more preferably an unsubstituted aryl group, or an aryl group substituted with a sulfo group (or salts thereof), a carboxyl group (or salts thereof), an alkyl group having 1 to 4 carbon atoms, an alkoxy group having 1 to 4 carbon atoms, or a halogen atom as a substituent), an aralkyl group which may be substituted, a cycloalkyl group which may be substituted, or a heterocyclic group which may be substituted, in which R and R' may be linked together to form a saturated carbon ring or a heterocycle constructed of an alkylene group including —O—.

$R_2$ and $R_3$ each independently represent a hydrogen atom or an alkyl group which may optionally be substituted (preferably an alkyl group having 1 to 4 carbon atoms, more preferably an unsubstituted alkyl group, or an alkyl group substituted with a hydroxyl group, a sulfo group (or salts thereof), a carboxy group (or salts thereof), or the like as a substituent).

$Y_1$ and $Y_2$ each independently represent a polymethylene group which may be substituted (preferably a polymethine group having 2 to 12 carbon atoms, more preferably an unsubstituted polymethine group, or a polymethylene group substituted with an alkyl group having 1 to 4 carbon atoms), an arylene group which may be substituted (preferably an arylene group having 6 to 12 carbon atoms, more preferably an unsubstituted arylene group, or an arylene group substituted with a sulfo group (or salts thereof), a carboxyl group (or salts thereof), an alkyl group having 1 to 4 carbon atoms, or a halogen atom as a substituent), or a cycloalkylene group (preferably a cycloalkylene group having 3 to 12 carbon atoms); Z represents —O—, —$SO_2$—, or —$CH_2$—, and m represents 0 (zero) or 1.

In the formula (I), furthermore, the respective groups have no need to correspond to the repetitive units and all of the repetitive units are not necessarily equal to each other and the sequence regularity of such repetitive units is also not restricted. As an example of the unit, one containing two different diamine components arrayed alternately disclosed as a specific example of compounds represented by the formula (I) in JP-B-04-32375 can be also preferably used.

The compound having repetitive units each represented by the formula (I) is a compound containing a 1,3,5-triazine ring. In this case, two or more repetitive units may be included and both opposite ends of the units may be linked together to form a cyclic structure. For explaining the details of the compound having the repetitive units each represented by the formula (I), at first, a preparing method (a synthetic method) will be described.

Briefly speaking, a method of preparing the above compound to be used in the present invention can produce a compound having a repetitive unit represented by the formula (I) by a polycondensation reaction between a 1,3,5-triazine compound represented by the following formula (A) and a diamino compound represented by the following formula (B) or a polycondensation reaction between a bis(halogeno-1,3,5-triazine) compound represented by the following formula (C) and the diamino compound represented by the formula (B).

Formula (A):

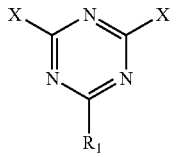

In the formula (A), X represents a halogen atom (e.g., chlorine or bromine), definition and preferable range of $R_1$ are the same as those of the formula (I), respectively.

$$H(R_2—)N—(Y_1\text{-}Z)_m\text{-}Y_2—N(—R_3)H \qquad \text{Formula (B)}$$

In the formula (B), definitions and preferable ranges of $R_2$, $R_3$, $Y_1$, $Y_2$, Z, and m are the same as those of the formula (I) above, respectively.

Formula (C):

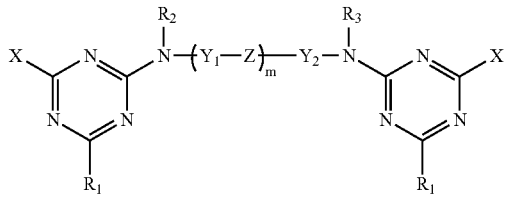

In the formula (C), X is the same as that of the formula (A) above; and definitions and preferable ranges of $R_1$, $R_2$, $R_3$, $Y_1$, $Y_2$, Z, and m are the same as those of the formula (I) above, respectively.

Examples of the halogeno-1,3,5-triazine compound represented by the formula (A) or (C) include those prepared by the process using cyanuric chloride as a starting material, which is described in Journal of the American Chemical Society, Vol. 73, pages 2981–2992 (1951).

Now, the compounds used in the present invention will be described in more detail.

Examples of $R_1$ in each of the compounds represented by the formula (I) and as the starting materials in the formulae (A) and (C) include the following groups:

—OH, —$OCH_3$, —$OC_2H_5$, —$OC_4H_9$,
—$SCH_3$, —$SC_2H_5$,
—$NH_2$, —$NHCH_3$,
—$NHC_2H_5$, —$NHC_4H_9$,
—$N(CH_3)_2$, —$NHC_{12}H_{25}$,
—$NHCH_2CH_2OH$, —$NHCH_2CH_2CH_2OH$,
—$N(CH_2CH_2OH)2$, —$NHCH_2CH_2$—$SO_3Na$,
—$NHCH_2CH_2$—$SO_3H$, —$NHCH_2$—COOH.

In addition, for the present invention, examples of —$N(R_2)$—$(Y_1\text{-}Z)_m\text{-}Y_2$—$N(R^3)$— in each of the compounds represented by the formula (I) and the starting materials or reagents for the polycondensation reaction represented by the formulae (B) and (C) include the following groups:

—$NH(CH_2)_2$—NH—, —$HN(CH_2)_3$—NH—,
—$HN(CH_2)_4$—NH—,
—$HN(CH_2)_6$—NH—, —$HN(CH_2)_{12}$—NH—,
—$HNCH_2CH_2$—O—$CH_2CH_2NH$—.

Specific examples of the method of preparing a compound that contains a repetitive unit represented by the formula (I) in the molecule, which is used in the present invention, include the following two general methods (a) and (b):

(a); A method of reacting 1 mol of a dihalogeno-1,3,5-triazine compound represented by the formula (A) and about 1 mol of the diamino compound represented by the formula (B) in an appropriate solvent (preferably, water, acetone, dioxane, dimethylformamide, diethylformamide, or the like) in the presence or absence of an appropriate deoxidizer (preferably, an inorganic base such as acidic carbon alkali, alkali carbonate, or caustic alkali, or an organic base such as pyridine, 2,4,6-trimethylpyridine, or diaminobicyclooctane) at an appropriate temperature (preferably 10 to 150° C.); and (b); A method of reacting 1 mol of a bis(halogeno-1,3,5-triazine) compound represented by the formula (C) and about 1 mol of a diamino compound represented by the formula (B) at an appropriate temperature (preferably 30 to 150° C.) using the same deoxidizer as that of the method (a).

Here, any compound having a repetitive unit of the formula (I) used in the present invention may be prepared by either the method (a) or (b) or may be prepared by another method.

Specific examples of the compound having a repetitive unit represented by the formula (I) used in the present invention will be listed below. The number of repetitive units in the molecule may be 2 or more, more preferably 2 to 20.

Compound I-1

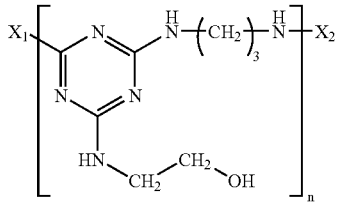

Compound I-2

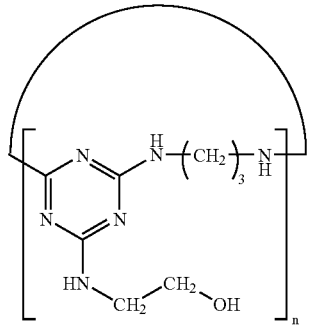

Compound I-3

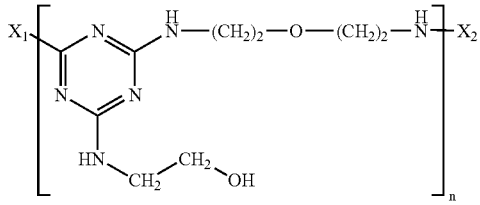

Compound I-4

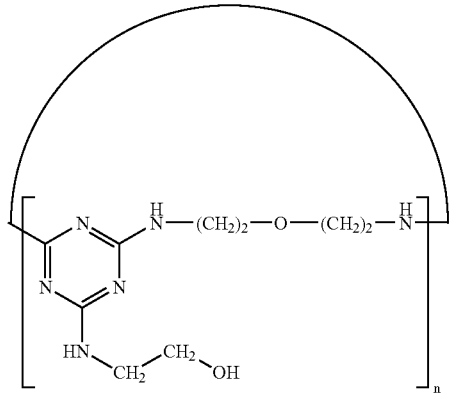

-continued

Compound I-5

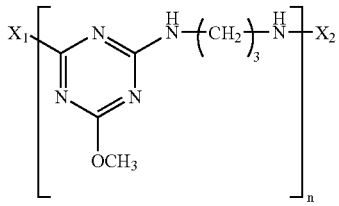

Compound I-6

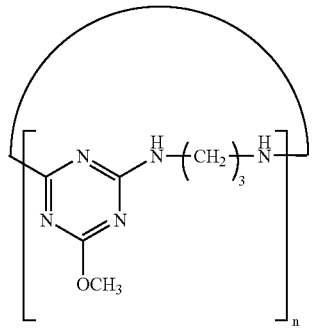

If the compound of the formula (I) is a chain polymer, the compound has both ends $X_1$ and $X_2$ and it is conceivable that $X_1$ is generally a halogen atom which is represented by X explained for the formula (A) or a hydroxyl group and $X_2$ is a hydrogen atom or a group wherein X is removed from one end in the formula (A) (but the remaining X is a halogen atom or a hydroxyl group just as in the case of above $X_1$). The compound represented by the formula (I) may have the number of repetitive units each containing a 1,3,5-triazine ring with distribution in a certain range or may contain impurities (such as one in which the end group $X_1$ is the same group as $R_1$) bonded with a substituent at an unintended position in the synthetic process.

A photosensitive material can contain the compound having the repetitive unit represented by the formula (I) by the addition and mixing of the compound at any time point in the process of preparing the photosensitive material (for example, at the step of preparing a silver halide emulsion or at the step of preparing a coating solution of the photosensitive material). In addition, either a non-photosensitive layer or a photosensitive silver halide emulsion layer can contain the compound having the repetitive unit represented by the formula (I). Preferably, it may be contained in the photosensitive silver halide emulsion layer. As one of preferred modes, it may be contained in a yellow-color-forming light-sensitive silver halide emulsion layer (a blue-light-sensitive silver halide emulsion layer). Furthermore, the compound having the repetitive unit represented by the formula (I) may be also contained in two or more light-sensitive silver halide emulsion layers. The compound content in the photosensitive material varies depending on its application. In general, the compound content is preferably 0.001 mg to 100 mg, more preferably 0.01 mg to 20 mg, still more preferably 0.05 mg to 10 mg per 1 $m^2$ of the light-sensitive material.

Furthermore, for allowing the silver halide emulsion layer to contain the compound having the repetitive unit represented by the formula (I), the compound content is preferably 1 mg to 10 g, more preferably 5 mg to 5 g, still more preferably 10 mg to 2 g per mol of silver halide in the target layer.

Next, the sensitizing dye preferably used in the present invention will be described in detail below.

The silver halide color photographic photosensitive material of the present invention is preferably one in which, the compound having the repetitive unit represented by the formula (I) is contained, while the silver halide emulsion in a yellow-color-forming light-sensitive silver halide emulsion layer is spectrally sensitized by at least one sensitizing dye represented by the following formula (II):

Formula (II)

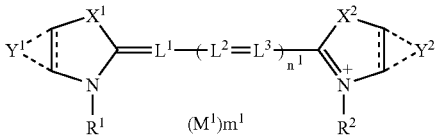

In the formula (II), $X^1$ and $X^2$ each independently represent an oxygen atom, a sulfur atom, a selenium atom, a tellurium atom, a nitrogen atom, or a carbon atom; $Y^1$ represents an atomic group necessary for forming a furan, pyrrole, thiophene, or benzene ring, which may be further condensed with another 5- or 6-membered carbon ring or heterocycle or may have a substituent; $Y^2$ represents an atomic group necessary for forming a benzene ring or a 5- or 6-membered unsaturated heterocycle, which may be further condensed with another 5- or 6-membered carbon ring or heterocycle or may have a substituent, in which a bond between two carbon atoms by which $Y^1$ and $Y^2$ are each condensed with the carbon ring or the heterocycle may be a single bond or a double bond; one of $R^1$ and $R^2$ represents an alkyl group substituted with an acidic group except a sulfo group and the other of $R^1$ and $R^2$ represents an alkyl group substituted with a sulfo group; $L^1$, $L^2$, and $L^3$ each independently represent a methine group; $n^1$ represents 0 (zero) or 1; $M^1$ represents a counter ion; and $m^1$ represents 0 (zero) or a larger number, which is necessary for neutralizing an electric charge in the molecule.

In the present invention, when a specific moiety is referred to as a "group", it means that the moiety itself may not be substituted, or may be substituted by at least one substituent (to the greatest number as possible). For example, an "alkyl group" means a substituted or unsubstituted alkyl group. The substituent available in the present invention includes any substituent, irrespective of the presence or absence of substitution.

Taking such a substituent as W, the substituent indicated by W may be any substituent, and there is no particular limitation thereon. Further, examples of the substituents include a halogen atom and an alkyl group (in the present invention, an aliphatic group is referred to as an alkyl group, so that an alkyl group (including a cyclic alkyl group) and alkenyl group (including a cyclic alkenyl group) and an alkynyl group are included. Furthermore, examples of the substituent include aryl, heterocyclic, cyano, hydroxyl, nitro, carboxyl, alkoxy, aryloxy, silyloxy, heterocyclic oxy, acyloxy, carbamoyloxy, alkoxycarbonyloxy, aryloxycarbonyloxy, amino (including anilino), ammonio, acylamino, aminocarbonylamino, alkoxycarbonylamino, aryloxycarbonylamino, sulfamoylamino, alkyl- or aryl-sulfonylamino), mercapto, alkylthio, arylthio, heterocyclic thio, sulfamoyl, sulfo, alkyl- or aryl-sulfinyl, alkyl- or aryl-sulfonyl, acyl, aryloxycarbonyl, alkoxycarbonyl, carbamoyl, arylazo or heterocyclicazo, imido, phosphio, phosphinyl, phosphinyloxy, phosphinylamino, phospho (which may be referred to as phosphono), and silyl groups. Other examples include a hydrazino group, an ureido group, a boronic group, a phosphate group, a sulfate group, and other known substituents.

More specifically, examples of W include: a halogen atom (a fluorine atom, a chlorine atom, a bromine atom, and an iodine atom, for example); and an alkyl group {[substituted or unsubstituted linear, branched, or cyclic alkyl groups including: an alkyl group (preferably, an alkyl group having 1 to 30 carbon atoms such as a methyl, ethyl, n-propyl, isopropyl, t-butyl, n-octyl, eicosyl, 2-chloroethyl, 2-cyanoethyl, or 2-ethylhexyl group); a cycloalkyl group (preferably, a substituted or unsubstituted cycloalkyl group having 3 to 30 carbon atoms such as a cyclohexyl, cyclopentyl, or 4-n-dodecylcyclohexyl group); a bicycloalkyl group (preferably, a substituted or unsubstituted bicycloalkyl group having 5 to 30 carbon atoms, that is, a monovalent group with one hydrogen atom removed from bicycloalkane having 5 to 30 carbon atoms such as bicyclo[1.2.2]heptan-2-yl, or bicyclo[2.2.2]octan-3-yl); and a group containing many cyclic structures such as a tricycle structure. The alkyl group in a substituent described below (such as an alkyl group in an alkylthio group) refers to an alkyl group of such a concept, but may further include an alkenyl group and an alkynyl group] and an alkenyl group [substituted or unsubstituted linear, branched, or cyclic alkenyl groups including: an alkenyl group (preferably, a substituted or unsubstituted alkenyl group having 2 to 30 carbons such as a vinyl, allyl, prenyl, geranyl, or oleyl group), a cycloalkenyl group (preferably, a substituted or unsubstituted cycloalkenyl group having 3 to 30 carbon atoms, that is, a monovalent group with one hydrogen atom removed from cycloalkene having 3 to 30 carbon atoms such as a 2-cyclopenten-1-yl or 2-cyclohexen-1-yl group), and a bicycloalkenyl group (a substituted or unsubstituted bicycloalkenyl group, preferably a substituted or unsubstituted bicycloalkenyl group having 5 to 30 carbon atoms, that is, a monovalent group with one hydrogen atom removed from bicycloalkene having one double bond such as a bicyclo[2.2.1]hept-2-en-1-yl or bicyclo[2.2.2]oct-2-en-4-yl group.)], other examples include alkynyl group, preferably a substituted or unsubstituted alkynyl group having 2 to 30 carbon atoms, such as ethynyl, propargyl, trimethyl, silylethynyl.}.

Hereinbelow, another examples of W are explained.

The aryl group is preferably a substituted or unsubstituted aryl group having 6 to 30 carbon atoms. Examples of the aryl group include a phenyl group, a p-tolyl group, a naphthyl group, a m-chlorophenyl group and an o-hexadecanoylaminophenyl group. It further includes a heterocyclic group. It is preferably a monovalent group with one hydrogen atom removed from a 5- or 6-membered substituted or unsubstituted aromatic or non-aromatic heterocyclic compound, and more preferably a 5- or 6-membered aromatic heterocyclic group having 3 to 30 carbon atoms. For instance, it may be 2-furyl, 2-thienyl, 2-pyrimydil, 2-benzothiazolyl. The heterocyclic group may be a cationic heterocyclic group such as a 1-methyl-2-pyridinio or 1-methyl-2-quinolinio group). It may be a cyano group, a hydroxyl group, a nitro group, a carboxyl group, an alkoxy group (preferably, a substituted or unsubstituted alkoxy group having 1 to 30 carbon atoms such as a methoxy, ethoxy, isopropoxy, t-butoxy, n-octyloxy, and 2-methoxyethoxy group).

The aryloxy group is preferably a substituted or unsubstituted aryloxy group having 6 to 30 carbon atoms. Examples of the aryloxy group include a phenoxy group, a 2-methylphenoxy group, a 4-t-buthylphenoxy group, a 3-nitrophenoxy group and a 2-tetradecanoylaminophenoxy group.

The silyloxy group is preferably a silyloxy group having 3 to 20 carbon atoms. Examples of the silyloxy group include a trimethylsilyloxy group and a t-butyldimethylsilyloxy group.

The heterocyclic oxy group is preferably a substituted or unsubstituted heterocyclic oxy group having 2 to 30 carbon atoms. Examples of the heterocyclic oxy group include a 1-phenyltetrazole-5-oxy group and a 2-tetrahydropyranyloxy group.

The acyloxy group is preferably a formyloxy group, a substituted or unsubstituted alkylcarbonyloxy group having 2 to 30 carbon atoms, or a substituted or unsubstituted arylcarbonyloxy group having 6 to 30 carbon atoms. Examples of the acyloxy group include a formyloxy group, an acetyloxy group, a pivaloyloxy group, a stealoyloxy group, a benzoyloxy group and a p-methoxyphenylcarbonyloxy group.

The carbamoyloxy group is preferably a substituted or unsubstituted carbamoyloxy group having 1 to 30 carbon atoms. Examples of the carbamoyloxy group include an N,N-dimethylcarbamoyloxy group, an N,N-diethylcarbamoyloxy group, a morpholinocarbonyloxy group, an N,N-di-n-octylaminocarbonyloxy group and an N-n-octylcarbamoyloxy group.

The alkoxycarbonyloxy group is preferably a substituted or unsubstituted alkoxycarbonyloxy group having 2 to 30 carbon atoms. Examples of the alkoxycarbonyloxy group include a methoxycarbonyloxy group, an ethoxycarbonyloxy group, a t-butoxycarbonyloxy group and a n-octylcarbonyloxy group.

The aryloxycarbonyloxy group is preferably a substituted or unsubstituted aryloxycarbonyloxy group having 7 to 30 carbon atoms. Examples of the aryloxycarbonyloxy group include a phenoxycarbonyloxy group, a p-methoxyphenoxycarbonyloxy group and a p-(n-hexadecyloxy)phenoxycarbonyloxy group.

The amino group is preferably an amino group, a substituted or unsubstituted alkylamino group having 1 to 30 carbon atoms, or a substituted or unsubstituted anilino group having 6 to 30 carbon atoms. Examples of the amino group include an amino group, a methylamino group, a dimethylamino group, an anilino group, an N-methyl-anilino group and a diphenylamino group.

The ammonio group is preferably an ammonio group, a substituted ammonio group having 1 to 30 carbon atoms substituted by a substituted or unsubstituted alkyl, aryl, or heterocyclic group such as a trimethylammonio, triethylammonio, or diphenylmethylammonio group.

The acylamino group is preferably a formylamino group, a substituted or unsubstituted alkylcarbonylamino group having 1 to 30 carbon atoms, or a substituted or unsubstituted arylcarbonylamino group having 6 to 30 carbon atoms. Examples of the acylamino group include a formylamino group, an acetylamino group, a pivaloylamino group, a lauroylamino group, a benzoylamino group and a 3,4,5-tri-n-octyloxyphenylcarbonylamino group.

The aminocarbonylamino group is preferably a substituted or unsubstituted aminocarbonylamino group having 1 to 30 carbon atoms. Examples of the aminocarbonylamino group include a carbamoylamino group, an N,N-dimethylaminocarbonylamino group, an N,N-diethylaminocarbonylamino group and a morpholinocarbonylamino group.

The alkoxycarbonylamino group is preferably a substituted or unsubstituted alkoxycarbonylamino group having 2 to 30 carbon atoms. Examples of the alkoxycarbonylamino group include a methoxycarbonylamino group, an ethoxycarbonylamino group, a t-butoxycarbonylamino group, a n-octadecyloxycarbonylamino group and an N-methylmethoxycarbonylamino group.

The aryloxycarbonylamino group is preferably a substituted or unsubstituted aryloxycarbonylamino group having 7 to 30 carbon atoms. Examples of the aryloxycarbonylamino group include a phenoxycarbonylamino group, a p-chlorophenoxycarbonylamino group and a m-(n-octyloxy)phenoxycarbonylamino group.

The sulfamoylamino group is preferably a substituted or unsubstituted sulfamoylamino group having 0 (zero) to 30 carbon atoms. Examples of the sulfamoylamino group include a sulfamoylamino group, an N,N-dimethylaminosulfonylamino group and an N-n-octylaminosulfonylamino group.

The alkyl- or aryl-sulfonylamino group is preferably a substituted or unsubstituted alkanesulfonylamino (alkyl sulfonylamino) group having 1 to 30 carbon atoms, or a substituted or unsubstituted aryl sulfonylamino group having 6 to 30 carbon atoms. Examples of the alkyl- or aryl-sulfonylamino group include a methyl sulfonylamino group, a butylsulfonylamino group, a phenylsulfonylamino group, a 2,3,5-trichlorophenylsulfonylamino group and a p-methylphenylsulfonylamino group.

Further, mercapto group is included as example of W.

The alkylthio group is preferably a substituted or unsubstituted alkylthio group having 1 to 30 carbon atoms. Examples of the alkylthio group include a methylthio group, an ethylthio group and a n-hexadecylthio group.

The arylthio group is preferably a substituted or unsubstituted arylthio group having 6 to 30 carbon atoms. Examples of the arylthio group include a phenylthio group, a p-chlorophenylthio group and a m-methoxyphenylthio group.

The heterocyclic thio group is preferably a substituted or unsubstituted heterocyclic thio group having 2 to 30 carbon atoms. Example of the heterocyclic thio group include a 2-benzothiazolylthio group and a 1-phenyltetraol-5-yl-thio group.

The sulfamoyl group is preferably a substituted or unsubstituted sulfamoyl group having 0 (zero) to 30 carbon atoms. Examples of the sulfamoyl group include an N-ethylsulfamoyl group, an N-(3-dodecyloxypropyl)sulfamoyl group, an N,N-dimethylsulfamoyl group, an N-acetylsulfamoyl group, an N-benzoylsulfamoyl group and an N-(N'-phenylcarbamoyl)sulfamoyl group.

The sulfo group is also included as example of W.

The alkyl- or aryl-sulfinyl group is preferably a substituted or unsubstituted alkylsulfinyl group having 1 to 30 carbon atoms, or a substituted or unsubstituted arylsulfinyl group having 6 to 30 carbon atoms. Examples of the alkyl- or aryl-sulfinyl group include a methylsulfinyl group, an ethylsulfinyl group, a phenylsulfinyl group and a p-methylphenylsulfinyl group.

The alkyl- or aryl-sulfonyl group is preferably a substituted or unsubstituted alkylsulfonyl group having 1 to 30 carbon atoms, a substituted or unsubstituted arylsulfonyl group having 6 to 30 carbon atoms. Examples of the alkyl- or aryl-sulfonyl group include a methylsulfonyl group, an ethylsulfonyl group, a phenylsulfonyl group and a p-methylphenylsulfonyl group.

The acyl group is preferably a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms in which the carbonyl group is bonded to a carbon atom in the heterocycle moiety. Examples of the acyl group include an acetyl group, a pivaloyl group, a 2-chloroacetyl group, a stearoyl group, a benzoyl group, a p-(n-octyloxy) phenylcarbonyl group, a 2-pyridylcarbonyl group, and a 2-furylcarbonyl group.

The aryloxycarbonyl group is preferably a substituted or unsubstituted aryloxycarbonyl group having 7 to 30 carbon atoms. Examples of the aryloxycarbonyl group include a phenoxycarbonyl group, an o-chlorophenoxycarbonyl group, a m-nitrophenoxycarbonyl group and a p-(t-butyl) phenoxycarbonyl group.

The alkoxycarbonyl group is preferably a substituted or unsubstituted alkoxycarbonyl group having 2 to 30 carbon atoms. Examples of the alkoxycarbonyl group include a methoxycarbonyl group, an ethoxycarbonyl group, a t-butoxycarbonyl group and a n-octadecyloxycarbonyl group.

The carbamoyl group is preferably a substituted or unsubstituted carbamoyl group having 1 to 30 carbon atoms. Examples of the carbamoyl group include a carbamoyl group, an N-methylcarbamoyl group, an N,N-dimethylcarbamoyl group, an N,N-di-n-octylcarbamoyl group and an N-(methylsulfonyl)carbamoyl group.

Further, examples thereof include: an aryl or heterocyclic azo group (preferably, a substituted or unsubstituted arylazo group having 6 to 30 carbon atoms and a substituted or unsubstituted heterocyclic azo group having 3 to 30 carbon atoms such as a phenylazo, p-chlorophenylazo, or 5-ethylthio-1,3,4-thiadiazol-2-ylazo group); and an imido group (preferably, an N-succinimide or N-phthalimide group).

The phosphino group is preferably a substituted or unsubstituted phosphino group having 2 to 30 carbon atoms. Examples of the phosphino group include a dimethylphosphino group, a diphenylphosphino group and a methylphenoxyphosphino group.

The phosphinyl group is preferably a substituted or unsubstituted phosphinyl group having 2 to 30 carbon atoms. Examples of the phosphinyl group include a phosphinyl group, a dioctyloxyphosphinyl group and a diethoxyphosphinyl group.

The phosphinyloxy group is preferably a substituted or unsubstituted phosphinyloxy group having 2 to 30 carbon atoms. Examples of the phosphinyloxy group include a diphenoxyphosphinyloxy group and a dioctyloxyphosphinyloxy group.

The phosphinylamino group is preferably a substituted or unsubstituted phosphinylamino group having 2 to 30 carbon atoms. Examples of the phosphinylamino group include a dimethoxyphosphinylamino group and a dimethylaminophosphinylamino group.

The phospho group is included as example of W, too.

The silyl group is preferably a substituted or unsubstituted silyl group having 3 to 30 carbon atoms. Examples of the silyl group include a trimethylsilyl group, a t-butyldimethylsilyl group and a phenyldimethylsilyl group.

Examples thereof include a hydrazino group (preferably, a substituted or unsubstituted hydrazino group having 0 to 30 carbon atoms such as a trimethylhydrazino group) and an ureido group (preferably, a substituted or unsubstituted ureido group having 0 to 30 carbon atoms such as an N,N-dimethylureido group).

Further, W may have a ring structure of collectively condensed two Ws (an aromatic or nonaromatic hydrocarbon ring, a heterocyclic ring, or a polycyclic condensed ring thereof in combination such as a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, an isoquinoline ring, a phthalazine ring, a naphthylidine ring, a quinoxaline ring, a quinoxazoline ring, a carbazole ring, a phenanthridine ring, an acrylidine ring, an phenanthroline ring, a thianthrene ring, a chromene ring, a xanthene ring, a phenoxathiin ring, a phenothiazine ring, or a phenazine ring).

The substituent may have a hydrogen atom removed, if containing a hydrogen atom, and may be substituted by the groups described above. Examples of such a substituent include: a —$CONHSO_2$— group (such as a sulfonyl carbamoyl group or a carbonyl sulfamoyl group); a —CONHCO— group (such as a carbonyl carbamoyl group); and an —$SO_2NHSO_2$— group (such as a sulfonyl sulfamoyl group).

Specific examples include: an alkyl carbonylaminosulfonyl group (such as an acetylaminosulfonyl group); an aryl carbonylaminosulfonyl group (such as a benzoylaminosulfonyl group); an alkanesulfonyl aminocarbonyl group (such as a methylsulfonyl aminocarbonyl group); and an arylsulfonyl aminocarbonyl group (such as a p-methylphenylsulfonyl aminocarbonyl group).

Next, a sensitizing dye represented by the formula (II) will be described in detail.

In the formula (II), $X^1$ and $X^2$ each independently represents an oxygen atom, a sulfur atom, a selenium atom, a tellurium atom, a nitrogen atom, or a carbon atom. The nitrogen atom can be preferably represented as —N(Rx)-, and the carbon atom can be preferably represented as —C(Ry)(Rz)-. Here, Rx, Ry, and Rz represent: a hydrogen atom or a monovalent substituent (such as the above-mentioned W); preferably an alkyl group, an aryl group, or a heterocyclic group; and more preferably an alkyl group. $X^1$ and $X^2$ each represents: preferably an oxygen atom, a sulfur atom, or a nitrogen atom; and more preferably an oxygen atom or a sulfur atom.

$Y^1$ represents an atomic group required for constituting a furan ring, a pyrrole ring, a thiophene ring, or a benzene ring, and may be condensed with other 5- to 6-membered carbon rings or heterocyclic rings or may contain a substituent. A bond between two carbon atoms of $Y^1$ forming a condensed ring may be a single bond or a double bond, but is preferably a double bond. $Y^1$ can further form a condensed ring with other 5- to 6-membered carbon rings or heterocyclic rings (such as a benzofuran ring, an indole ring, a benzothiophene ring, or a naphthalene ring). $Y^1$ is preferably a thiophene ring. $Y^1$ may contain any substituent, but the substituent preferably includes the above-mentioned W, for example. Preferable examples of the substituent include: an alkyl group (such as a methyl group); an aryl group (such as a phenyl group); an aromatic heterocyclic group (such as an 1-pyrrolyl group); an alkoxy group (such as an methoxy group); and an alkylthio group (such as a methylthio group); a cyano group; an acyl group (such as an acetyl group); an alkoxycarbonyl group (such as a methoxy carbonyl group); and a halogen atom (such as fluorine, chlorine, bromine, or iodine). More preferable examples of the substituent include a methyl group, a methoxy group, a cyano group, and a halogen atom. Still more preferable examples of the substituent include a halogen atom. Particularly preferable examples of the substituent include a fluorine, chlorine, and bromine atom. Most preferable examples of the substituent include a chlorine atom. $Y^1$ as a thiophene ring, is preferably unsubstituted or preferably contains a halogen substituent. The substituent is preferably a chlorine or bromine atom, most preferably a chlorine atom.

$Y^2$ represents a group required for constituting a benzene ring a 5- or 6-membered unsaturated heterocyclic ring. It may be further condensed with other 5- to 6-membered carbon rings or heterocyclic rings or may contain a substituent. A bond between two carbon atoms of $Y^2$ forming a condensed ring may be a single bond or a double bond, but is preferably a double bond. Examples of the 5-memebered unsaturated heterocyclic ring formed by $Y^2$ include a pyrrole ring, a pyrazole ring, an imidazole ring, a triazole ring, a furan ring, an oxazole ring, an isoxazole ring, a thiophene ring, a thiazole ring, a isothiazole ring, a thiadiazole ring, a selenophene ring, a selenazole ring, an isoselenazole ring, a tellurophene ring, a tellurazole ring, and an isotellurazole ring. Examples of the 6-memebered unsaturated heterocyclic ring include a pyridine ring, a pyridazine ring, a pyrimidine ring, a pyrazine ring, a pyran ring, and a thiopyran ring. Further, $Y^2$ can condense with other 5- to 6-membered carbon rings or heterocyclic rings to form an indole ring, a benzofuran ring, a benzothiophene ring, and a thienothiophene ring, for example, but a tertiary condensed ring preferably does not exist. $Y^2$ is preferably a benzene ring, a pyrrole ring, a furan ring, and a thiophene ring. $Y^2$ is particularly preferably a benzene ring, a furan ring, and a pyrrole ring. $Y^2$ is most preferably a benzene ring. $Y^2$ may contain any substituent, but the substituent preferably includes the above-mentioned W, for example. Preferable examples of the substituent include: an alkyl group such as a methyl group; an aryl group (such as a phenyl group); an aromatic heterocyclic group (such as an 1-pyrrolyl group); an alkoxy group (such as an methoxy group); and an alkylthio group (such as a methylthio group); a cyano group; an acyl group (such as an acetyl group); an alkoxycarbonyl group (such as a methoxy carbonyl group); and a halogen atom (such as fluorine, chlorine, bromine, or iodine). More preferable examples of the substituent include a methyl group, a methoxy group, a cyano group, and a halogen atom. Still more preferable examples of the substituent include a halogen group. Particularly preferable examples of the substituent include a fluorine, chlorine, and bromine atom. Most preferable examples of the substituent include a chlorine atom.

One of $R^1$ and $R^2$ represents an alkyl group substituted by an acid group except for a sulfo group, and the other represents an alkyl group substituted by a sulfo group.

Here, the acid group will be described. The acid group is a group containing dissociative protons.

Specific examples of the group in which protons dissociate depending on pKa and pH of an environment include a sulfo group, a carboxyl group, a sulfate group, a —$CONHSO_2$— group (such as a sulfonyl carbamoyl group or a carbonyl sulfamoyl group), a —CONHCO— group (such as a carbonyl carbamoyl group), an —$SO_2NHSO_2$— group (such as a sulfonyl sulfamoyl group), a sulfonamide group, a sulfamoyl group, a phosphate group, a phosphono group, a boronic acid group, and a phenolic hydroxide group. Preferable examples of the acid group include a proton dissociative acid group capable of dissociating 90% or more protons within the range of pH 5 to 11.

A preferable "alkyl group substituted by an acid group" represented by $R^1$ or $R^2$ according to the methine dye represented by the formula (II) can be expressed as the following equation.

Preferable alkyl group=-Qa-$T^1$

Qa represents a connecting group (preferably, a divalent connecting group such as an alkylene group) required for forming the above-mentioned alkyl group. $T^1$ represents —$SO_3$—, —$CO_2H$, —$CONHSO_2Ra$, —$SO_2NHCORb$, —CONHCORc, or —$SO_2NHSO_2Rd$.

Qa represents a connecting group (preferably, a divalent connecting group) required for forming the alkyl group. Ra, Rb, Rc, and Rd each independently represents an alkyl group, an aryl group, a heterocyclic ring group, an alkoxy group, an aryloxy group, a heterocyclic oxy group, or an amino group.

Qa may be any connecting group as long as the above requirements are satisfied. However, Qa preferably represents a connecting group consisting of an atom or an atomic group containing at least one kind of an atom selected from a carbon atom, a nitrogen atom, a sulfur atom, and an oxygen atom. Qa preferably represents an alkylene group (such as a methylene, ethylene, trimethylene, tetramethylene, pentamethylene, or methyltrimethylene group), an alkenylene group (such as an ethenylene or propenylene group), an alkynylene group (such as an ethynylene or propynylene group), or a connecting group constituted by those groups in combination with one or more selected from the group consisting of —CON(Re)—, —$CO_2$—, —$SO_2$N(Re)—, —$SO_2$—O—, —N(Re)CON(Rf)—, —$SO_2$—, —SO—, —S—, —O—, —CO—, —N(Wa)- and having 1 to 10 carbon atoms, preferably 1 to 8 carbon atoms, and more preferably 1 to 5 carbon atoms.

Here, Re and Rf each independently represents a hydrogen atom, an alkyl group, an aryl group, or a heterocyclic ring group. Wa represents a hydrogen atom or a monovalent substituent, and examples of the monovalent substituent include the above-mentioned W.

The connecting group may contain a substituent represented by the above-mentioned W or may contain a ring (such as an aromatic or nonaromatic hydrocarbon ring or a heterocyclic ring).

However, the connecting group Q preferably does not contain a hetero atom. Further, the connecting group is preferably not substituted by a substituent represented by the above-mentioned W.

Qa is more preferably a divalent connecting group having 1 to 5 carbon atoms constituted by one or more groups in combination selected from the group consisting of: an alkylene group having 1 to 5 carbon atoms (such as a methylene, ethylene, trimethylene, tetramethylene, pentamethylene, or methyltrimethylene group); an alkenylene group having 2 to 5 carbon atoms (such as an ethenylene or propenylene group); and an alkynylene group having 2 to 5 carbon atoms (such as ethynylene and propynylene). Qa is particularly preferably constituted by an alkylene group having 1 to 5 carbon atoms (preferably, a methylene, ethylene, trimethylene, or tetramethylene group).

Qa is constituted by more preferably an ethylene, trimethylene, tetramethylene, or methyltrimethylene group, particularly preferably a trimethylene group, when $T^1$ is a sulfo group. Qa is constituted still more preferably by a methylene, ethylene, or trimethylene group, and particularly preferably by a methylene group, when Xa is a carboxyl group.

Qa is constituted still more preferably by a methylene, ethylene, or trimethylene group, and particularly preferably by a methylene group, when T is —$CONHSO_2$Ra, $SO_2$NHCORb, CONHCORc, or $SO_2NHSO_2$Rd.

Ra, Rb, Rc, and Rd each independently represents an alkyl group, an aryl group, a heterocyclic ring group, an alkoxy group, an aryloxy group, a heterocyclyloxy group, or an amino group.

Preferable examples thereof include: an unsubstituted alkyl group having 1 to 18 carbon atoms, preferably 1 to 10 carbon atoms, and more preferably 1 to 5 carbon atoms (such as a methyl, ethyl, propyl, or butyl group); a substituted alkyl group having 1 to 18 carbon atoms, preferably 1 to 10 carbon atoms, more preferably 1 to 5 carbon atoms (including a hydroxymethyl, trifluoromethyl, benzyl, carboxyethyl, ethoxycarbonylmethyl, acetylaminomethyl, and unsaturated hydrocarbon group having preferably 2 to 18 carbon atoms, more preferably 3 to 10 carbon atoms, particularly preferably 3 to 5 carbon atoms (such as a vinyl, ethynyl, 1-cyclohexenyl, benzylidyne, or benzylidene group); a substituted or unsubstituted aryl group having 6 to 20 carbon atoms, preferably 6 to 15 carbon atoms, more preferably 6 to 10 carbon atoms (such as a phenyl, naphthyl, p-carboxyphenyl, p-nitrophenyl, 3,5-dichlorophenyl, p-cyanophenyl, m-fluorophenyl, or p-tolyl group); a heterocyclic ring group having 1 to 20 carbon atoms, preferably 2 to 10 carbon atoms, more preferably 4 to 6 carbon atoms which may be substituted (such as a pyridyl, 5-methylpyridyl, thienyl, furyl, morpholino, or tetrahydrofurfuryl group); an alkoxy group having 1 to 10 carbon atoms, preferably 1 to 8 carbon atoms (such as a methoxy, ethoxy, 2-methoxyethoxy, 2-hydroxyethoxy, or 2-phenylethoxy group, for example); an aryloxy group having 6 to 20 carbon atoms, preferably 6 to 12 carbon atoms, more preferably 6 to 10 carbon atoms (such as a phenoxy, p-methylphenoxy, p-chlorophenoxy, or naphthoxy group); a heterocyclic oxy group having 1 to 20 carbon atoms, preferably 3 to 12 carbon atoms, more preferably 3 to 10 carbon atoms (an oxy group substituted by a heterocyclic group such as a 2-thienyloxy or 2-morpholinoxy group); and an amino group having 0 (zero) to 20 carbon atoms, preferably 0 (zero) to 12 carbon atoms, more preferably 0 (zero) to 8 carbon atoms (such as an amino, methylamino, dimethylamino, ethylamino, diethylamino, hydroxyethylamino, benzylamino, anilino, diphenylamino, morpholino forming a ring, or pyrrolidino group). Those may be substituted by the above-mentioned W. More preferable examples thereof include a methyl group, an ethyl group, and a hydroxyethyl group. A particularly preferable example thereof includes a methyl group.

The acid group such as a carboxyl group or a dissociative nitrogen atom may be represented in a non-dissociated form (COOH or NH) or in a dissociated form ($COO^-$ or $N^-$). The acid group actually may be in a dissociated state or in a non-dissociated state depending on the environment in which the dye is placed such as pH. The acid group may be represented as ($COO^-Na^+$) or ($N^-Na^+$), for example, when a cation exists as a counter ion. The acid group is represented as (COOH) or (NH) in a non-dissociated state, but can also be represented as ($COO^-H^+$) or ($N^-H^+$), assuming that a cationic compound of a counter ion is a proton.

According to a methine dye represented by the formula (II), one of $R^1$ and $R^2$ represents an alkyl group substituted by an acid group except a sulfo group, and the other represents an alkyl group substituted by a sulfo group. The alkyl group containing a sulfo group is preferably a 3-sulfopropyl group, a 4-sulfobutyl group, a 3-sulfobutyl group, or a 2-sulfoethyl group and more preferably a 3-sulfopropyl group. The alkyl group substituted by an acid group except the sulfo group is an alkyl group substituted by preferably a carboxyl group, a —$CONHSO_2$— group, an —$SO_2$NHCO— group, a —CONHCO— group, or an —$SO_2NHSO_2$ group, and by more preferably a carboxymethyl group or a methanesulfonyl carbamoylmethyl group.

Combinations of $R^1$ and $R^2$ include: preferably a carboxymethyl group or a methanesulfonyl carbamoylmethyl group for one and a 3-sulfopropyl group, a 4-sulfobutyl group, a 3-sulfobutyl group, or a 2-sulfoethyl group for the other; and more preferably a carboxymethyl group or a methanesulfonyl carbamoylmethyl group for one and a 3-sulfopropyl group for the other.

$L^1$, $L^2$, and $L^3$ each independently represent a methine group and may be unsubstituted or substituted by a substituent (such as the above-mentioned W). Preferable examples of the substituent include an aryl group, an unsaturated hydrocarbon group, a carboxyl group, a sulfo group, a sulfate group, a cyano group, a halogen group (such as fluorine, chlorine, bromine, or iodine), a hydroxy group, a mercapto group, an alkoxy group, an aryloxy group, an alkylthio group, an arylthio group, an acyl group, an alkoxycarbonyl group, an aryloxycarbonyl group, an acyloxy group, a carbamoyl group, a sulfamoyl group, a heterocyclic ring group, an alkanesulfonyl carbamoyl group, an acylcarbamoyl group, an acylsulfamoyl group, and an alkanesulfonylsulfamoyl group.

$n^1$ represents a number selected from 0 and 1. $L^1$ is preferably an unsubstituted methine group when $n^1$ is 0. $L^1$ and $L^3$ each are preferably an unsubstituted methine group and $L^2$ is preferably a methine group substituted by an unsubstituted alkyl group (such as a methyl, ethyl, or propyl group) when $n^1$ is 1. $L^2$ is more preferably a methine group substituted by an ethyl group when $n^1$ is 1.

$M^1$ represents a counter ion and is included in the formula for representing the presence of a cation or an anion when the counter ion is required for converting ion charge of a dye to neutral. Whether a dye is a cation or an anion, or whether a dye has net ion charge depends on the substituent and the environment in the solution (such as pH). Typical examples of the cation include: inorganic cations such as a hydrogen ion ($H^+$), an alkali metal ion (such as a sodium ion, a potassium ion, or a lithium ion), or an alkali earth metal ion (such as a calcium ion); and organic ions such as an ammonium ion (such as an ammonium ion, a tetraalkylammonium ion, a triethylammonium ion, a pyridinium ion, an ethylpyridinium ion, or a 1,8-diazabicyclo[5.4.0]-7-undecenium ion). An anion may be an inorganic anion or an organic anion, and examples thereof include a halide anion (such as a fluoride ion, a chloride ion, a bromide ion, or an iodide ion), a substituted arylsulfonate ion (such as a p-toluenesulfonate ion or a p-chlorobenzenesulfonate ion), an aryldisulfonate ion (such as a 1,3-benzensulfonate ion, a 1,5-naphthalenedisulfonate ion, or a 2,6-naphthalenedisulfonate ion), an alkylsulfonate ion (such as a methylsulfonate ion), a sulfonate ion, a thiocyanate ion, a perchlorate ion, a tetrafluoroborate ion, a picrate ion, an acetate ion, and a trifluoromethanesulfonate ion. Further, an ionic polymer or other dyes containing opposite charge with the dye may be used as well.

Examples of a preferable cation include a sodium ion, a potassium ion, a triethylammonium ion, a tetraethylammonium ion, a pyridinium ion, an ethylpyridinium ion, and a methylpyridinium ion. Examples of a preferable anion include a perchlorate ion, an iodide ion, a bromide ion, and a substituted arylsulfonate ion (such as a p-toluenesulfonate ion).

$m^1$ represents an integer of 0 or more required for balancing charge, and $m^1$ is 0 when forming an inner salt. $m^2$ preferably represents an integer of 0 to 4.

The sensitizing dye represented by the above formula (II) is more preferably represented by the following formula (III), (IV), or (V).

Formula (III):

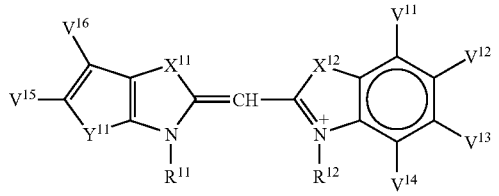

$(M^{11})m^{11}$

In the formula (III), $Y^{11}$ represents an oxygen atom, a sulfur atom, or N—$R^{13}$, where $R^{13}$ represents a hydrogen atom or an alkyl group; $V^{15}$ and $V^{16}$ each independently represent a hydrogen atom or a monovalent substituent; $X^{11}$ and $X^{12}$ each independently represent an oxygen atom or a sulfur atom; one of $R^{11}$ and $R^{12}$ represents an alkyl group substituted with an acidic group except a sulfo group, and the other represents an alkyl group substituted with a sulfo group; $V^{11}$, $V^{12}$, $V^{13}$, and $V^{14}$ each independently represent a hydrogen atom or a monovalent substituent; $M^{11}$ represents a counter ion; and $m^{11}$ represents an integer of 0 or larger which is necessary for neutralizing a charge in the molecule.

Formula (IV):

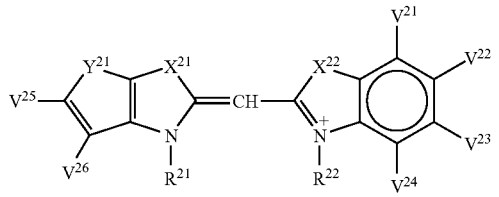

$(M^{21})m^{21}$

In the formula (IV), $Y^{21}$ represents an oxygen atom, a sulfur atom, or N—$R^{23}$, where $R^{23}$ represents a hydrogen atom or an alkyl group; $V^{25}$ and $V^{26}$ each independently represent a hydrogen atom or a monovalent substituent; $X^{21}$ and $X^{22}$ each independently represent an oxygen atom or a sulfur atom; one of $R^{21}$ and $R^{22}$ represents an alkyl group substituted with an acidic group except a sulfo group, and the other represents an alkyl group substituted with a sulfo group; $V^{21}$, $V^{22}$, $V^{23}$, and $V^{24}$ each independently represent a hydrogen atom or a monovalent substituent; $M^{21}$ represents a counter ion; and $m^{21}$ represents an integer of 0 or larger which is necessary for neutralizing a charge in the molecule.

Formula (V):

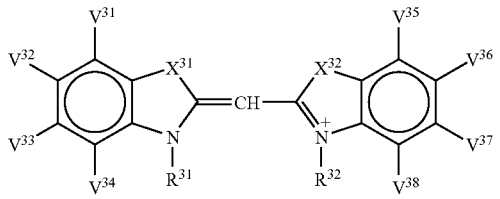

$(M^{31})m^{31}$

In the formula (V), $X^{31}$ and $X^{32}$ each independently represent an oxygen atom or a sulfur atom; one of $R^{31}$ and $R^{32}$ represents an alkyl group substituted with an acidic group except a sulfo group, and the other represents an alkyl group substituted with a sulfo group; $V^{31}$, $V^{32}$, $V^{33}$, $V^{34}$, $V^{35}$, $V^{36}$, $V^{37}$, and $V^{38}$ each independently represent a hydrogen atom or a monovalent substituent, where two substituents adjacent to each other may be linked together to form a condensed ring; $M^{31}$ represents a counter ion; and $m^{31}$ represents an integer of 0 or larger which is necessary for neutralizing a charge in the molecule.

Hereinafter, the sensitizing dyes represented by the formulae (III), (IV), and (V) will be further described. In the formula (III), $Y^{11}$ represents an oxygen atom, a sulfur atom, or N—$R^{13}$, where $R^{13}$ represents a hydrogen atom, an unsubstituted alkyl group, or a substituted alkyl group (for example, an alkyl group in which the above W is substituted). A substituent for the substituted alkyl group is preferably a substituent having hydrophilic property higher than an iodine atom, more preferably a substituent having hydrophilic property equal to or higher than that of a chlorine atom, particularly preferably an alkyl group substituted with a substituent having hydrophilic property equal to or higher than that of a fluorine atom. $R^{13}$ is further preferably a hydrogen atom or an unsubstituted alkyl group, particularly preferably a hydrogen atom or a methyl group. In particular, preferable $Y^{11}$ is a sulfur atom.

$X^{11}$ and $X^{12}$ each independently represent an oxygen atom or a sulfur atom, and at least one of them is preferably a sulfur atom or both of them are preferably sulfur atoms.

$V^{11}$, $V^{12}$, $V^{13}$, $V^{14}$, $V^{15}$, and $V^{16}$ each independently represent a hydrogen atom or a monovalent substituent. Among $V^{11}$, $V^{12}$, $V^{13}$, and $V^{14}$, two substituents adjacent to each other or $V^{15}$ and $V^{16}$ may be linked together to form a saturated or unsaturated condensed ring, but preferably such a condensed ring is not formed. The monovalent substituents include W described above, preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl), or a halogen atom (for example, fluorine, chlorine, bromine, or iodine), more preferably a methyl group, a methoxy group, a cyano group, or a halogen atom, still more preferably a halogen atom, particularly preferably a fluorine atom, a chlorine atom, or a bromine atom, and most preferably a chlorine atom. Preferably, $V^{11}$, $V^{12}$, and $V^{14}$ are hydrogen atoms.

If $Y^{11}$ is a sulfur atom, it is preferable that both of $V^{15}$ and $V^{16}$ are hydrogen atoms or one of them is a halogen atom (for example, fluorine, chlorine, bromine, or iodine), more preferably $V^{16}$ is a hydrogen atom and $V^{15}$ is a hydrogen atom or a chlorine atom.

One of $R^{11}$ and $R^{12}$ represents an alkyl group substituted with any acidic group except a sulfo group (preferably substituted with a carboxyl group or an alkane sulfonylcarbamoyl group), and the other represents an alkyl group substituted with a sulfo group. In addition, the specific examples of the alkyl groups substituted with those acidic groups and preferable combinations thereof are the same as those of $R^1$ described above. More preferably, one of $R^{11}$ and $R^{12}$ represents a carboxymethyl group or a methanesulfonyl carbamoylmethyl group. $R^{11}$ is particularly preferably a carboxymethyl group or a methanesulfonyl carbamoylmethyl group and $R^{12}$ is a 3-sulfopropyl group.

$M^{11}$ represents a counter ion, and $m^{11}$ represents an integer of 0 or larger, which is necessary for neutralizing a charge in the molecule. In this case, $M^{11}$ and $m^{11}$ are the same as those of $M^1$ and $m^1$ described above, respectively. In particular, preferable $M^{11}$ is a cation. Preferable cations include sodium, potassium, triethylammonium, pyridinium, and N-ethylpyridinium ions.

In the formula (IV), $Y^{21}$ represents an oxygen atom, a sulfur atom, or N—$R^{23}$, where $R^{23}$ represents a hydrogen atom, an unsubstituted alkyl group, or a substituted alkyl group (for example, an alkyl group in which the above W is substituted). A substituent for the substituted alkyl group is preferably a substituent having hydrophilic property higher than an iodine atom, more preferably a substituent having hydrophilic property equal to or higher than that of a chlorine atom, particularly preferably an alkyl group substituted with a substituent having hydrophilic property equal to or higher than that of a fluorine atom. $R^{23}$ is further preferably a hydrogen atom or an unsubstituted alkyl group, particularly preferably a hydrogen atom or a methyl group. In particular, preferable $Y^{21}$ is a sulfur atom.

$X^{21}$ and $X^{22}$ each independently represent an oxygen atom or a sulfur atom, and at least one of them is preferably a sulfur atom or both of them are preferably sulfur atoms.

$V^{21}$, $V^{22}$, $V^{23}$, $V^{24}$, $V^{25}$, and $V^{26}$ each independently represent a hydrogen atom or a monovalent substituent. Among $V^{21}$, $V^{22}$, $V^{23}$, and $V^{24}$, two substituents adjacent to each other or $V^{25}$ and $V^{26}$ may be linked together to form a saturated or unsaturated condensed ring, but preferably such a condensed ring is not formed. The monovalent substituents include W described above, preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl), or a halogen atom (for example, fluorine, chlorine, bromine, or iodine), more preferably a methyl group, a methoxy group, a cyano group, or a halogen atom, still more preferably a halogen atom, particularly preferably a fluorine atom, a chlorine atom, or a bromine atom, and most preferably a chlorine atom. Preferably, $V^{21}$, $V^{22}$, and $V^{24}$ are hydrogen atoms.

If $Y^{21}$ is a sulfur atom, it is preferable that both of $V^{25}$ and $V^{26}$ are hydrogen atoms or one of them is a halogen atom (for example, fluorine, chlorine, bromine, or iodine), more preferably $V^{26}$ is a hydrogen atom and $V^{25}$ is a hydrogen atom or a chlorine atom.

One of $R^{21}$ and $R^{22}$ represents an alkyl group substituted with any acidic group except a sulfo group (preferably substituted with a carboxyl group or an alkane sulfonylcarbamoyl group) and the other represents an alkyl group substituted with a sulfo group. In addition, the specific examples of the alkyl groups substituted with those acidic groups and preferable combinations thereof are the same as those of $R^1$ described above. More preferably, one of $R^{21}$ and $R^{22}$ represents a carboxymethyl group or a methanesulfonyl carbamoylmethyl group. $R^{21}$ is particularly preferably a carboxymethyl group or a methanesulfonyl carbamoylmethyl group and $R^{22}$ is a 3-sulfopropyl group.

$M^{21}$ represents a counter ion, and $m^{21}$ represents an integer of 0 or larger, which is necessary for neutralizing a charge in the molecule. In this case, $M^{21}$ and $m^{21}$ are the same as those of $M^1$ and $m^1$ described above, respectively. In particular, preferable $M^{21}$ is a cation. Preferable cations include sodium, potassium, triethylammonium, pyridinium, and N-ethylpyridinium ions.

In the formula (V), $X^{31}$ and $X^{32}$ each independently represent an oxygen atom or a sulfur atom, and at least one of them is preferably a sulfur atom or both of them are preferably sulfur atoms.

One of $R^{31}$ and $R^{32}$ represents an alkyl group substituted with any acidic group except a sulfo group (preferably substituted with a carboxyl group or an alkane sulfonylcarbamoyl group) and the other represents an alkyl group substituted with a sulfo group. In addition, the specific examples of the alkyl groups substituted with those acidic groups and preferable combinations thereof are the same as those of $R^1$ described above. More preferably, one of $R^{31}$ and $R^{32}$ represents a carboxymethyl group or a methanesulfonyl carbamoylmethyl group. Particularly preferably, $R^{31}$ is a carboxymethyl group or a methanesulfonyl carbamoylmethyl group and $R^{32}$ is a 3-sulfopropyl group.

$V^{31}$, $V^{32}$, $V^{33}$, $V^{34}$, $V^{35}$, $V^{36}$, $V^{37}$, and $V^{38}$ each independently represent a hydrogen atom or a monovalent substituent, and two substituents adjacent to each other may be linked together to form a condensed ring. The substituents adjacent to each other may be linked together to form a saturated or unsaturated condensed ring. The examples of the condensed ring include a naphthalene ring formed by combining $V^{33}$ and $V^{34}$ together. The monovalent substituents include W described above, preferably an alkyl group (for example, methyl), an aryl group (for example, phenyl), an aromatic heterocyclic group (for example, 1-pyrrolyl), an alkoxyl group (for example, methoxy), an alkylthio group (for example, methylthio), a cyano group, an acyl group (for example, acetyl), an alkoxycarbonyl group (for example, methoxycarbonyl), or a halogen atom (for example, fluorine, chlorine, bromine, or iodine), more preferably a methyl group, a methoxy group, a cyano group, or a halogen atom, still more preferably a halogen atom, particularly preferably a fluorine atom, a chlorine atom, or a bromine atom, and most preferably a chlorine atom. Preferably, $V^{31}$, $V^{32}$, $V^{34}$, $V^{35}$, $V^{36}$ and $V^{38}$ are hydrogen atoms.

$M^{31}$ represents a counter ion, and $m^{31}$ represents an integer of 0 or larger, which is necessary for neutralizing a charge in the molecule. In this case, $M^{31}$ and $m^{31}$ are the same as those of $M^1$ and $m^1$ described above, respectively. In particular, preferable $M^{31}$ is a cation. Preferable cations include sodium, potassium, triethylammonium, pyridinium, and N-ethylpyridinium ions.

For each of the sensitizing dyes represented by the formulae (II) to (V), preferable compounds will be described below.

Preferably, $X^{11}$, $X^{12}$, and $Y^{11}$ ($X^{21}$, $X^{22}$, and $Y^{21}$) ($X^{31}$, $X^{32}$) each represents a sulfur atom, $V^{15}$ ($V^{25}$) represents a hydrogen atom or a chlorine atom, and $V^{16}$ ($V^{26}$) represents a hydrogen atom. Preferably, each of $V^{11}$, $V^{12}$, and $V^{14}$ ($V^{21}$, $V^{22}$, and $V^{24}$)($V^{31}$, $V^{32}$, $V^{34}$, $V^{35}$, $V^{36}$, and $V^{38}$) is a hydrogen atom, and each of $V^{13}$($V^{23}$)($V^{33}$, $V^{37}$) is an alkyl group (for example, methyl), an alkoxy group (for example, methoxy), an alkylthio group (for example, methylthio), a cyano group, an acyl group (for example, acetyl), an alkoxycarbonyl group (for example, methoxycarbonyl), or a halogen atom (for example, fluorine, chlorine, bromine, or iodine). Among them, a methyl group, a methoxy group, a cyano group, an acetyl group, a methoxycarbonyl group, and a halogen atom are more preferable, a halogen atom is particularly preferable, fluorine and chlorine atoms are most preferable.

It is preferable that one of $R^{11}$ and $R^{12}$ ($R^{21}$ and $R^{22}$) ($R^{31}$ and $R^{32}$) is a carboxymethyl group or a methanesulfonyl carbamoylmethyl group, and the other is a 3-sulfopropyl group. It is particularly preferable that $R^{11}$ ($R^{21}$) ($R^{31}$) is a carboxymethyl group or a methanesulfonyl carbamoylmethyl group, and $R^{12}$ ($R^{22}$) ($R^{32}$) is a 3-sulfopropyl group.

$M^{11}$ ($M^{21}$) ($M^{31}$) is preferably an organic or inorganic monovalent cation and $m^{11}$ ($m^{21}$) ($m^{31}$) is preferably 0 or 1.

For the use of the dye of the formula (II) as a blue sensitive emulsion layer, the dye is selected from those represented by the formulae (III), (IV), and (V), more preferably the formula (III) or (IV), particularly preferably the formula (III).

Although the addition amount of the sensitizing dye represented by each of the formulae (II) to (V) varies widely depending on cases, it is preferably from $0.5\times10^{-6}$ mol to $1.0\times10^{-2}$ mol, more preferably from $1.0\times10^{-6}$ mol to $5.0\times10^{-3}$ mol, per 1 mol of silver halide.

In the following description, specific examples of the sensitizing dyes represented by the formulae (II) to (V) of the present invention will be given, although the scope of the present invention is not limited thereto.

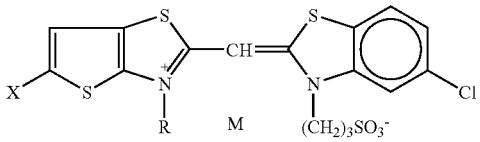
| | X | H | M |
|---|---|---|---|
| S-1 | Cl | $CH_2CONHSO_2CH_3$ | — |
| S-2 | Cl | $CH_2CO_2H$ | — |
| S-3 | Br | $CH_2CO_2H$ | — |
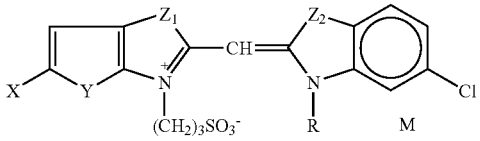
| | X | Y | $Z_1$ | $Z_2$ | R | M |
|---|---|---|---|---|---|---|
| S-4 | Cl | O | S | S | $CH_2CO_2H$ | — |
| S-5 | Cl | NH | S | S | $CH_2CONHSO_2CH_3$ | — |
| S-6 | Br | O | S | S | $CH_2CO_2H$ | — |
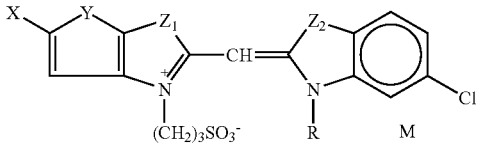
| | X | Y | $Z_1$ | $Z_2$ | R | M |
|---|---|---|---|---|---|---|
| S-7 | Cl | S | O | S | $CH_2CO_2H$ | — |
| S-8 | Cl | NH | S | S | $CH_2SO_2NHCOCH_3$ | — |
| S-9 | Br | O | S | S | $CH_2CO_2H$ | — |
S-10
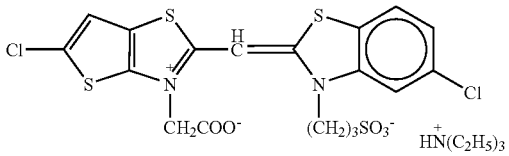
S-11
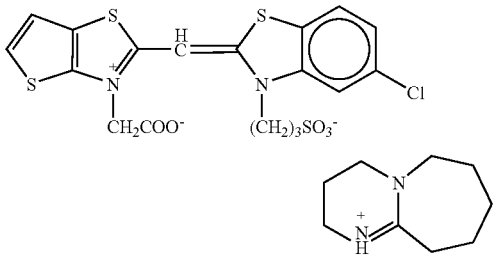
S-12
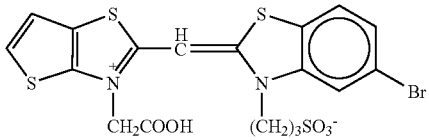
S-13
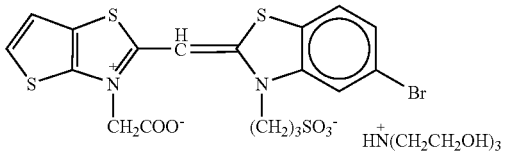
-continued
S-14
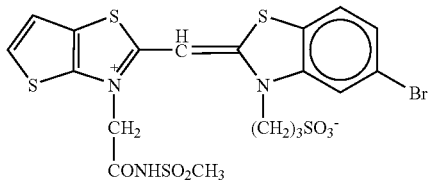
S-15
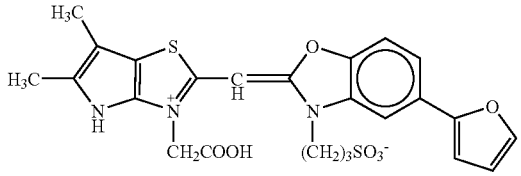
S-16
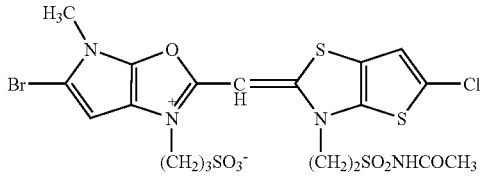
S-17
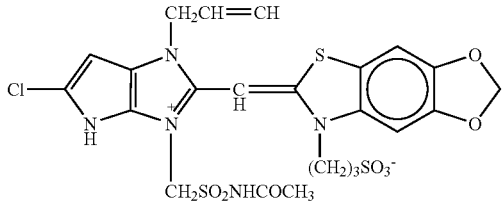
S-18
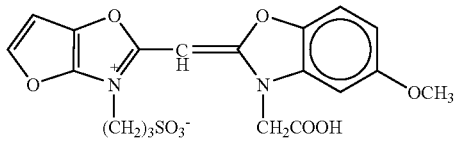
S-19
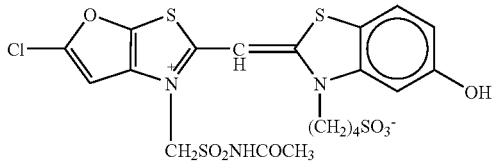
S-20
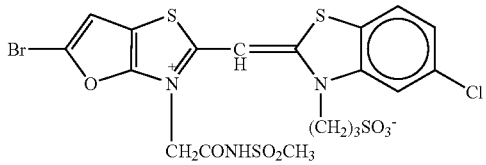
S-21
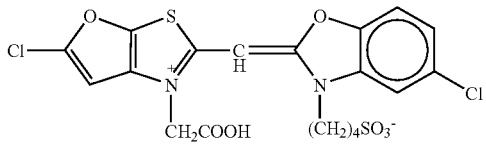
S-22
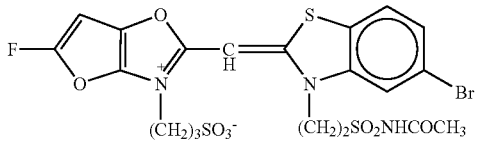

-continued
S-23
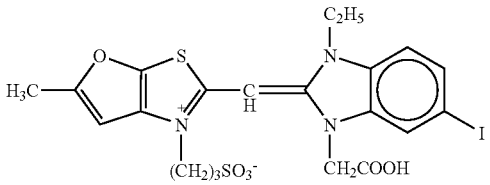
S-24
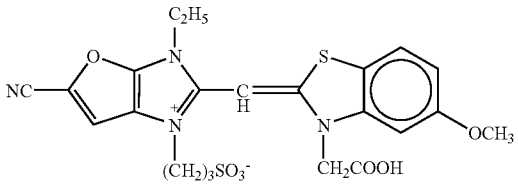
S-25
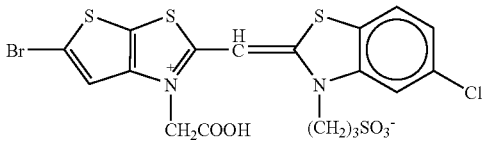
S-26
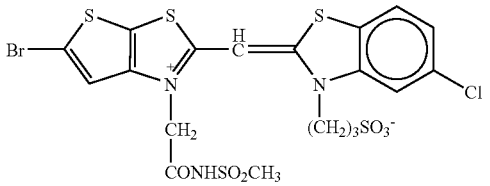
S-27
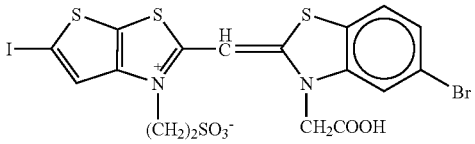
S-28
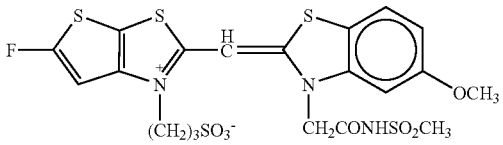
S-29
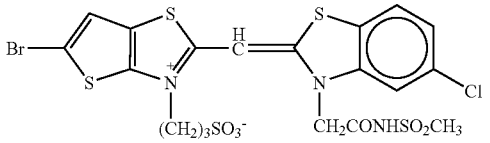
S-30
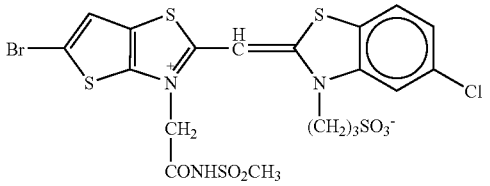
S-31
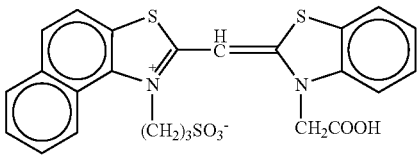
-continued
S-32
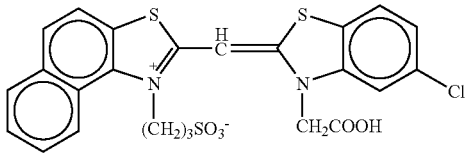
S-33
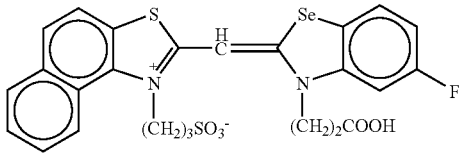
S-34
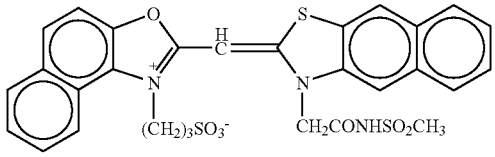
S-35
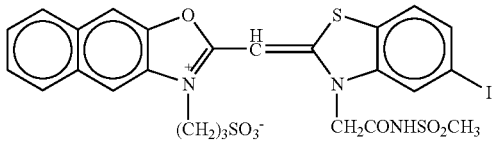
S-36
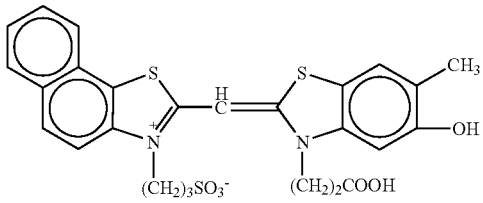
S-37
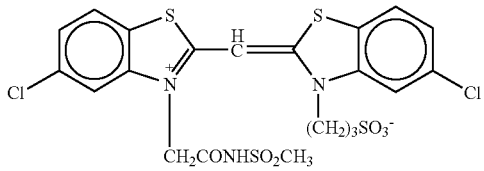
S-38
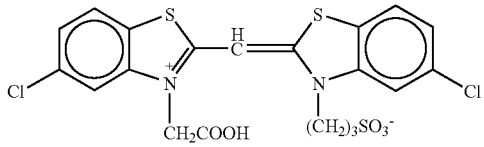
S-39
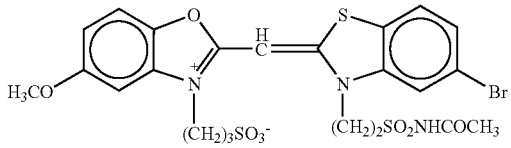
S-40
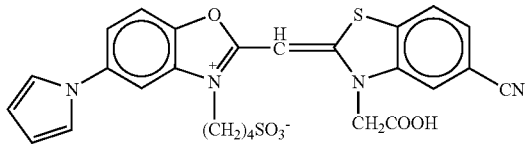

-continued

S-41

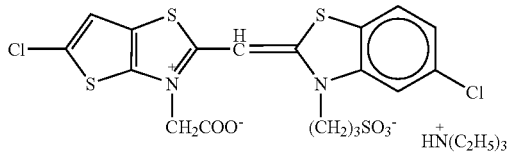

S-42

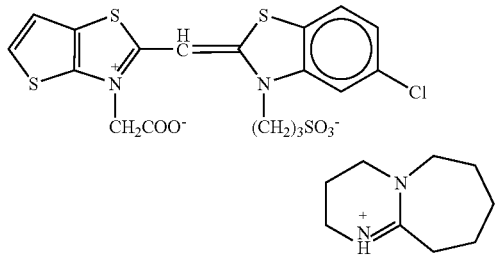

S-43

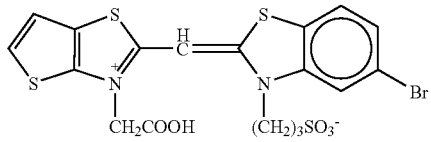

S-44

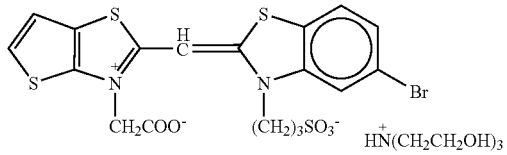

S-45

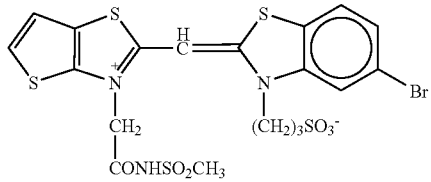

The sensitizing dye represented by the formula (II), (III), (IV) or (V) can be synthesized according to the methods described in the following documents:

a) F. M. Hamer, "Heterocyclic Compounds-Cyanine dyes and related compounds" (John Wiley & Sons, New York, London, 1964);

b) D. M. Sturmer, "Heterocyclic Compounds-Special topics in heterocyclic chemistry" chapter 8, section 4, pages 482 to 515 (John Wiley & Sons, New York, London, 1977); and c) "Rodd's Chemistry of Carbon Compounds", the second edition, volume 4, part B, chapter 15, pages 369 to 422 (Elsevier Science Publishing Company Inc., New York, 1977).

For allowing those sensitizing dyes to be contained in silver halide emulsions, they may be directly dispersed in the emulsions, or may be added to the emulsions as solutions in which they are dissolved in sole or mixed solvents of solvents such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide.

Although the amount of the sensitizing dye to be used varies depending on the form and size of silver halide grains, it is preferably from 0.1 to 4 mmol, more preferably from 0.2 to 2.5 mmol, per mol of silver halide. Further, it may be used in combination with another sensitizing dye.

Hereinafter, the silver halide emulsions will be described.

In the present invention, at least one of light-sensitive silver halide emulsion layers in a photosensitive material layer contains a silver halide emulsion whose silver chloride content is 90 mol % or more (hereinafter, referred to as a specific silver halide emulsion). The specific silver halide emulsion may be used in yellow-, magenta-, and/or cyan-color-forming light-sensitive silver halide emulsion layer, but preferably is used in at least the yellow-color-forming light-sensitive silver halide emulsion layer and more preferably is used in each of the yellow-, magenta-, and/or cyan-color-forming light-sensitive silver halide emulsion layers.

The specific silver halide emulsion for use in the present invention will be explained as follows.

For using the specific silver halide emulsion in the yellow-color-forming light-sensitive silver halide emulsion layer, preferably, the silver halide grains in the silver halide emulsion is substantially composed of crystalline grains of a cubic structure having a (100) plane or a tetradecahedral (tetrakaidecahedral) structure (they may have rounded grain apexes and they may have higher order planes). The cubic grains substantially having the (100) plane are those in which no crystal plane is confirmed except those six (100) crystal planes with defined boundaries between the planes, where the edges and corners thereof may be rounded off to a certain extent due to ripening. In addition, the tetradecahedral crystalline grains are those having partially or wholly defined boundaries by (100) crystal planes while satisfying the relative directions and spaces of the cubic grains, for example, those having three pairs of parallel (100) crystal planes at equal intervals and eight (111) crystal planes, where the edges and corners thereof may be rounded off to a certain extent due to ripening. The grain size is preferably 0.05 μm or less (preferably from 0.1 μm to 0.55 μm), more preferably 0.51 μm or less (preferably from 0.1 μm to 0.51 μm), most preferably 0.3 μm or less (preferably 0.1 μm to 0.3 μm) in cube-equivalent side length.

For using the specific silver halide emulsion in the magenta- and cyan-color-forming light-sensitive silver halide emulsion layers, the grain form of the silver halide emulsion is not particularly limited. Preferably, however, the silver halide grains in the silver halide emulsion is substantially formed of crystalline grains of a cubic structure having the (100) plane or a tetradecahedral structure (they may have rounded grain apexes and they may have higher order planes), an octahedral crystal lattice, or plate-like grains having a (100) or (111) plane as the principal plane with an aspect ratio of 2 or more. The aspect ratio means a value obtained by dividing a diameter of a circle equivalent to a projected area by a thickness of the grain. The plate-like grains having the (100) or (111) plane as the principal plane is described in JP-A-2000-352794 (i.e., in the description from the paragraph "0003" (page 7) to the paragraph "0040" (page 8)) which is preferably herein incorporated by reference. The grain size is preferably 0.4 μm or less (preferably from 0.1 am to 0.4 μm), more preferably 0.3 μm or less (preferably from 0.1 μm to 0.3 μm) in cube-equivalent side length.

The term "cube side length" or "cube-equivalent side length" used herein represents the length of one side of a cube when the volume of each grain is converted to an equal volume of cube. It is preferable that the emulsion that can be used in the present invention includes grains showing a monodisperse size distribution. The variation coefficient in cube-equivalent side length of the total emulsion grains defined in the present invention is preferably 20% or less, more preferably 15% or less, still more preferably 10% or less. A variation coefficient of cube-equivalent side lengths of all grains in a silver halide emulsion defined in the present invention is preferably 20% or less, more preferably 15% or less, still more preferably 10% or less. The variation coefficient of the cube-equivalent side lengths is expressed with a percentage of a standard deviation of the cube-equivalent side lengths of individual grains to an average value of the cube-equivalent side lengths. At this time, for the purpose of obtaining broader latitudes, the above monodispersed emulsions are preferably blended and used in one layer or multiply coated.

The silver halide emulsion that can be used in the present invention may additionally contain silver halide grains other than the silver halide grains in the silver halide emulsion defined in the present invention (i.e., specific silver halide grains). However, the silver halide emulsion defined in the present invention should have the silver halide grains defined in the present invention in an amount of 50% or more, preferably 80% or more, more preferably 90% or more with respect to the total projected area of the total grains.

In the silver halide emulsion used in the present invention, the silver chloride content is 90 mol % or more. In particular, when the silver halide emulsion layer contains a yellow-dye forming coupler, the silver chloride content should be 90 mol % or more. From a viewpoint of rapid processing, the silver chloride content is more preferably 93 mol % or more, more preferably 95 mol % or more. The silver bromide content, being excellent in the latent image stability with a high contrast, is preferably 0.1 to 7 mol %, more preferably 0.5 to 5 mol %. The silver iodide content, being highly sensitive and exhibiting hard tone under high-illuminance exposure, is preferably 0.005 to 1 mol %, more preferably 0.01 to 0.60 mol %, most preferably 0.02 to 0.50 mol %. The specific silver halide grains defined in the present invention are preferably silver iodidobromochloride grains, and more preferably the silver iodobromochloride grains having the above halogen composition.

On the other hand, the silver halide emulsion layers that contain a magenta- or cyan-dye forming coupler each preferably have the same silver halide content as that of the silver halide emulsion layer that contains a yellow-dye forming coupler.

The silver halide grain for use in the invention has preferably a region where a content of silver bromide and/or silver iodide is higher than those in other regions, in the silver halide grains. In some cases, the silver halide grain for use in the present invention contains silver chloride, silver bromide and/or silver iodide uniformly distributed throughout the entire grain, and it partially contains a region where the content of silver bromide and/or silver iodide is high. However, as described later, the case where most of regions are formed only with silver chloride is preferred. Hereinafter, a region where the content of silver bromide is higher than that in other regions will be referred to as a silver bromide-containing phase and likewise a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The local silver bromide content in the silver bromide-containing phase is preferably 5 mole % or more, more preferably from 10 to 80 mole %, and most preferably from 15 to 50 mole %. The local silver iodide content in the silver iodide-containing phase is preferably 0.3 mole % or more, more preferably from 0.5 to 8 mole %, and most preferably from 1 to 5 mole %. Such silver bromide- or silver iodide-containing phase may be present in plural numbers in layer form, within the grain, respectively. In this case, the phases may have different silver bromide or silver iodide contents from each other. The silver halide grain for use in the invention has at least one of the silver bromide-containing phase and silver iodide-containing phase, respectively.

It is also preferable (important) that the silver bromide-containing phase and the silver iodide-containing phase of the silver halide emulsion for use in the present invention are each formed in the layer form so as to surround the grain. One preferred embodiment is that the silver bromide-containing phase or the silver iodide-containing phase formed in the layer form so as to surround the grain has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion has the silver bromide-containing phase or the silver iodide-containing phase formed in the layer form so as to surround the grain in the vicinity of a surface of the grain, the silver bromide or silver iodide concentration of a corner portion or an edge of the grain can be different from that of a main plane of the grain. Further, aside from the silver bromide-containing phase or the silver iodide-containing phase formed in the layer form so as to surround the grain in the vicinity of a surface of the grain, the silver bromide-containing phase or the silver iodide-containing phase not surrounding the grain may exist in isolation at a specific portion of the surface of the grain.

In a case where the silver halide emulsion to be used in the present invention contains a silver bromide-localized phase, it is preferable that said silver bromide-localized phase is formed in a layer form so as to have a concentration maximum of silver bromide inside of a grain. Likewise, in a case where the silver halide emulsion to be used in the present invention contains a silver iodide-localized phase, it is preferable that said silver iodide-localized phase is formed in a layer form so as to have a concentration maximum of silver iodide surface of a grain.

Such silver bromide-containing phase or silver iodide-containing phase is constituted preferably with a silver amount of 3% to 30% of the grain volume, and more preferably with a silver amount of 3% to 15%, in the meaning to increase the local concentration with a less silver bromide or silver iodide content.

The silver halide grain of the silver halide emulsion for use in the present invention preferably contains both a silver bromide-containing phase and a silver iodide-containing phase. In this case, the silver bromide-containing phase and the silver iodide-containing phase may exist either at the same place in the grain or at different places thereof. However, it is preferred that they exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide or silver iodide content necessary for exhibiting the effects of the present invention such as achievement of high sensitivity and realization of hard gradation, increases with the silver bromide-containing phase or silver iodide-containing phase is being formed inside a grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To a silver halide grain for use in the present invention, bromide ions or iodide ions are introduced to make the grain include silver bromide or silver iodide. In order to introduce bromide ions or iodide ions, a bromide or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in the form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high silver chloride emulsion may be restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, thereby an emulsion having higher sensitivity and lower fog can be obtained.

On the other hand, the addition of a bromide salt solution is preferably started at 50% or outer side of the volume of a grain, more preferably 70% or outer side of the volume of an emulsion grain.

The distribution of a bromide ion concentration and iodide ion concentration in the depth direction of a grain can be measured according to an etching/TOF-SIMS (Time of Flight-Secondary Ion Mass Spectrometry) method by means of, for example, TRIFT II Model TOF-SIMS apparatus (trade name, manufactured by Phi Evans Co.). A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection-Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. It is preferred that the emulsion for use in the present invention has the maximum concentration of iodide ions at the surface of the grain, and the iodide ion concentration decreases inwardly in the grain. The bromide ions preferably have the maximum concentration in the inside of a grain. The local concentration of silver bromide can also be measured with X-ray diffractometry, as long as the silver bromide content is high to some extent.

The silver halide in the present invention preferably contains iridium. As an iridium compound, the six-coordination complex having iridium as the central metal and 6 ligands is preferable in order to be incorporated uniformly in the silver halide crystal. As a preferable embodiment of iridium used in the present invention, a six-coordination complex having Ir as the central metal and Cl, Br or I as the ligands is preferable. There is more preferably a six-coordination complex in which all of 6 ligands are made of Cl, Br or I and wherein Ir is the central metal. In this case, Cl, Br or I may be a mixture of them in the six-coordination complex. The six-coordination complex whose center metal is iridium and which has Cl, Br or I as a ligand(s) is particularly preferably incorporated in a silver bromide-containing phase for obtaining hard gradation upon high illuminance exposure.

Specific examples of the iridium complex in which all of 6 ligands are made of Cl, Br or I are shown below. However, the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

As another example of iridium used in the present invention, a six-coordination complex having at least one ligand except for a halogen or a cyan and containing iridium as a central metal is preferable. A six-coordination complex having $H_2O$, OH, O, OCN, thiazole, or substituted thiazoles, as a ligand and containing iridium as a central metal is preferable. A six-coordination complex in which at least one ligand is made of $H_2O$, OH, O, OCN, thiazole, or substituted thiazoles, and the remaining ligands are made of Cl, Br or I and iridium is a central metal is more preferable.

Specific examples of the six-coordination complex in which at least one ligand is made of $H_2O$, OH, O, OCN, thiazole, or substituted thiazoles, and the remaining ligands are made of Cl, Br or I and iridium is a central metal are listed below. However, iridium in the present invention is not limited thereto.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{2-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$ The foregoing metal complexes are anionic ions. When these are formed into salts with cationic ions, counter cationic ions are preferably soluble in water. Specifically, alkali metal ions such as a sodium ion, a potassium ion, a rubidium ion, a cesium ion and a lithium ion, an ammonium ion and an alkyl ammonium ion are preferable. These metal complexes can be used being dissolved in water or mixed solvents of water and appropriate water-miscible organic solvents (such as alcohols, ethers, glycols, ketones, ethers and amines). The iridium complexes are added in amounts of, preferably $1\times10^{-10}$ mole to $1\times10^{-3}$ mole, most preferably $1\times10^{-8}$ mole to $1\times10^{-5}$ mole, per mole of silver during grain formation.

In the present invention, it is preferable that the above-mentioned iridium complex is incorporated into the silver halide grains by directly adding the same to a reaction solution for the formation of the silver halide grains, or to an aqueous solution of the halide for the formation of the silver halide grains, or to another solution and then to the reaction solution for the grain formation. It is also preferable that the complex is incorporated into the silver halide grains by physical aging with fine grains having iridium complex previously incorporated therein. Further, it can be also contained into the silver halide grains by a combination of these methods.

In case where these complexes are doped (incorporated) to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is preferably covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain.

There is no particular limitation with respect to the halogen composition at a position where the above-mentioned complexes are contained. However, the six-coordination complex, in which all of 6 ligands are made of Cl, Br or I and wherein Ir is the central metal, is preferably contained in a region of the maximum concentration of silver bromide.

In the present invention, it is preferable to contain a rhodium compound. More preferably, the compound that can be used is represented by the following formula (VI):

$$[RhQ_nL^I_{(6-n)}]^m.$$

In the formula (VI), Q represents a halogen atom such as a chlorine, bromine, or iodine atom, preferably a bromine atom; $L^1$ represents an arbitrary ligand different from Br; n represents 3, 4, 5, or 6; and m preferably represents 3−, 2−, 1−, 0, or 1+. $L^I$ may be an inorganic or organic charged or non-charged compound, and is preferably an inorganic compound. $L^I$ is preferably $Cl^-$, $H_2O$, NO, or NS, more preferably $H_2O$; n is preferably 5 or 6, more preferably 6; and m is preferably 3− or 2−, more preferably 3−.

In the following description, preferable specific examples of a metal complex represented by the formula (VI) will be given, but the present invention is not particularly limited thereto.

$[RhBr_5Cl]^{3-}$ $[RhBr_6]^{3-}$ $[RhBr_5(H_2O)]^{2-}$ $[RhBr_4(H_2O)_2]^-$

In case of that foregoing metal complexes represented by the formula (VI) are anionic ions, when these are formed into salts with cationic ions, counter cationic ions are preferably soluble in water. Specifically, alkali metal ions such as a sodium ion, a potassium ion, a rubidium ion, a cesium ion and a lithium ion, an ammonium ion and an alkyl ammonium ion are preferable. These metal complexes can be used being dissolved in water or mixed solvents of water and appropriate water-miscible organic solvents (such as alcohols, ethers, glycols, ketones, ethers and amines).

Though optimum amounts of those metal complexes vary depending on the size of silver halide grains added or the like, during the grain formation, they are preferably used at concentrations of $5\times10^{-10}$ mol to $1\times10^{-7}$ mol, more preferably $2\times10^{-10}$ mol to $8\times10^{-8}$ mol, particularly preferably $5\times10^{-10}$ mol to $5\times10^{-8}$ mol per mol of silver.

In the present invention, metal ion other than iridium or rhodium can be doped in the inside and/or on the surface of the silver halide grains. As the metal ion to be used, a transition metal is preferable, and iron, ruthenium, osmium, lead, cadmium or zinc is especially preferable. It is more preferable that these metal ions are used in the form of a six-coordination complex of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion are preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in the molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. In the present invention, one of these compounds is preferably used in combination with the iridium compound. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver. In the present invention, in case of a ruthenium complex and an osmium complex, nitrosyl ion, thionitrosyl ion, water molecule and chloride ion are preferably used as ligands, singly or in combination. More preferably these ligands form a pentachloronitrosyl complex, a pentachlorothionitrosyl complex, or a pentachloroaquo complex. The formation of a hexachloro complex is also preferred. These complexes are preferably added, during grain formation, in an amount of $1\times10^{-10}$ mol to $1\times10^{-6}$ mol, more preferably $1\times10^{-9}$ mol to $1\times10^{-6}$ mol, per mol of silver.

Spectral sensitizing dyes which are used in the light-sensitive silver halide for use in the present invention for spectral sensitization of green and red light regions include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

The silver halide emulsion for use in the present invention is preferably subjected to gold sensitization as known in the art. As the gold sensitization, various kinds of inorganic gold compounds, gold (I) complexes having inorganic ligands, and gold (I) compounds having organic ligands can be utilized. As the inorganic gold compounds, for instance, chloroauric acids or salts thereof can be used. As the gold (I) complexes having inorganic ligands, for instance, gold dithiocyanate compounds such as potassium gold (I) dithiocyanates or gold (I) dithiosulfate compounds such as trisodium gold (I) dithiocyanate can be used.

Chalcogen sensitization and gold sensitization can be conducted simultaneously using the same molecule such as a molecule capable of releasing $AuCh^-$ in which Au represents Au (I), and Ch represents a sulfur atom, a selenium atom or a tellurium atom. Examples of the molecule capable of releasing $AuCh^-$ include gold compounds represented by AuCh-L in which L represents an atomic group bonding to AuCh to form a molecule. Further one or more ligands may co-ordinate to Au together with Ch-L. The gold compounds represented by AuCh-L have a tendency to form AgAuS (Ch═S), AgAuSe (Ch═Se), or AgAuTe (Ch═Te), when the gold compounds are reacted in a solvent in the presence of silver ions. Examples of the gold compounds include those compounds in which L is an acyl group. In addition, gold compounds represented by the following formula (AuCh1), formula (AuCh2), or formula (AuCh3) are exemplified.

$R_1$—X-M-ChAu Formula (AuCh1)

wherein Au represents Au (I); Ch represents a sulfur atom, a selenium atom or a tellurium atom; M represents a substituted or unsubstituted methylene group; X represents an oxygen atom, a sulfur atom, a selenium atom or $NR_2$; $R_1$ represents an atomic group bonding to X to form a molecule (organic groups such as alkyl, aryl and heterocyclic groups); $R_2$ represents a hydrogen atom or a substituent (organic groups such as alkyl, aryl and heterocyclic groups); or $R_1$ and M may combine together to form a ring.

Regarding the compound represented by formula (AuCh 1), Ch is preferably a sulfur atom or a selenium atom; X is preferably an oxygen atom or a sulfur atom; and $R_1$ is preferably an alkyl group or an aryl group. Examples of more specific compounds include Au(I) salts of thiosugar (for example, gold thioglucose (such as αgold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Here, the terms "thiosugar", "selenosugar" and "tellurosugar" mean the compounds in which a hydroxyl group in the anomer position of the sugar is substituted with a SH group, a SeH group and a TeH group respectively.

$W_1(W_2)C{=}C(R_3)ChAu$ Formula (AuCh2)

wherein Au represents Au(I); Ch represents a sulfur atom, a selenium atom or a tellurium atom; $R_3$ and $W_2$ each independently represent a substituent (for example, a hydrogen atom, a halogen atom, or an organic group such as alkyl, aryl and heterocyclic groups); $W_1$ represents an electron-withdrawing group having a positive value of the Hammett's substituent constant $\sigma_p$ value; or $R_3$ and $W_1$, $R_3$ and $W_2$, or $W_1$ and $W_2$ may bond together to form a ring respectively.

Regarding the compound represented by formula (AuCh 2), Ch is preferably a sulfur atom or a selenium atom; $R_3$ is preferably a hydrogen atom or an alkyl group; and each of $W_1$ and $W_2$ is preferably an electron-withdrawing group having the Hammett's substituent constant op value of 0.2 or more. Examples of more specific compounds include $(NC)_2C{=}CHSAu$, $(CH_3OCO)_2C{=}CHSAu$, and $CH_3CO(CH_3OCO)C{=}CHSAu$.

$W_3$-E-ChAu Formula (AuCh3)

wherein Au represents Au(I); Ch represents a sulfur atom, a selenium atom or a tellurium atom; E represents a substituted or unsubstituted ethylene group; $W_3$ represents an electron-withdrawing group having a positive value of the Hammett's substituent constant $\sigma_p$ value.

Regarding the compound represented by formula (AuCh 3), Ch is preferably a sulfur atom or a selenium atom; E is preferably an ethylene group with an electron-withdrawing group having a positive value of the Hammett's substituent constant $\sigma_p$ value; and $W_3$ is preferably an electron-withdrawing group having the Hammett's substituent constant $\sigma_p$ value of 0.2 or more. An addition amount of these compounds can vary over a wide range according to the occasions. However, the amount is generally in the range of $5\times10^{-7}$ to $5\times10^{-3}$ mole, preferably in the range of $3\times10^{-6}$ to $3\times10^{-4}$ mole, per mole of silver halide respectively.

The silver halide emulsion for use in the present invention is preferably subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1996). The above-mentioned Research Disclosure discloses a method using a thiocyanate ion when producing a colloidal gold sulfite. However, in place thereof, there can be used a thioether compound such as methionine and thiodiethanol.

The colloidal gold sulfide can be used in a wide range of size. Specifically, it is preferable to use compounds of 50 nm or less, more preferably 10 nm or less, and furthermore preferably 3 nm or less, in terms of average grain size respectively. The grain size can be measured from a TEM photograph. The composition of the colloidal gold sulfide may be $Au_2S_1$ or a composition of excess sulfur such as $Au_2S_1$ to $Au_2S_2$, with the composition of excess sulfur being preferred. $Au_2S_{1.1}$ to $Au_2S_{1.8}$ is more preferable.

The chemical composition analysis can be carried out by the steps of taking gold sulfide particles and measuring the content of gold and the content of sulfur using analytical methods such as IPC and iodometry. If gold ions or sulfur ions (including hydrogen sulfide and its salt) dissolved in a liquid phase exist in a colloid dispersion of gold sulfide, they give an adverse influence on the chemical composition analysis. Therefore, gold sulfide particles are separated by, for example, an ultrafiltration before analysis. An addition amount of the colloid dispersion of gold sulfide can vary over a wide range according to the occasions. The amount in terms of gold is generally in the range of $5\times10^{-7}$ to $5\times10^{-3}$ mole, preferably in the range of $5\times10^{-6}$ to $5\times10^{-4}$ mole, per mole of silver halide respectively.

In the present invention, the above-mentioned gold sensitization may be combined with other chemical sensitization such as sulfur sensitization, selenium sensitization, tellurium sensitization, reduction sensitization and noble metal sensitization using noble metals other than gold compounds. Particularly, the gold sensitization is preferably combined with sulfur sensitization, or selenium sensitization.

Various compounds or precursors thereof can be included in the silver halide emulsion for use in the present invention to prevent fogging from occurring or to stabilize photographic performance during manufacture, storage or photographic processing of the light-sensitive material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 are also preferably used.

Further, in order to enhance storage stability of the silver halide emulsion for use in the present invention, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description at paragraph Nos. 0036 to 0071 of JP-A-11-327094 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts of these acids); hydroxylamines represented by the formula (A) described in U.S. Pat. No. 5,556,741 (the description of line 56 in column 4 to line 22 in column 11 of U.S. Pat. No. 5,556,741 is preferably acceptable for the present invention and is incorporated herein); water-soluble reducing agents represented by formula (I), (II), or (III) of JP-A-11-102045.

In the silver halide color photosensitive material of the present invention, a total coated silver amount in the photographic constituent layers is preferably 0.15 to 0.50 $g/m^2$ and more preferably 0.20 to 0.46 $g/m^2$.

The blue sensitive emulsion layer of the silver halide color photosensitive material of the present invention can be particularly exposed with an unlimited exposure device using a cathode ray, a gas laser, a light-emitting diode, a semiconductor laser, a second harmonic generation light source (SHG) comprising a combination of nonlinear optical crystal with a semiconductor laser or a solid state laser using a semiconductor laser as an excitation light source, but is preferably exposed with an exposure device using a coherent light. As a device to carry out exposure to such a coherent light, the coherent light can be emitted from variable lasers and is preferably emitted from a semiconductor laser from the viewpoint of cost. As an example of the semiconductor laser, use can be made preferably of a blue light semiconductor laser having an oscillation wavelength of 430 to 450 nm (Presentation by Nichia Corporation at the $48^{th}$ Applied Physics Related Joint Meeting in March of 2001), although a blue laser at about 470 nm obtained by wavelength modulation of a semiconductor laser (oscillation wavelength about 940 nm) with a SHG crystal of $LiNbO_3$ having a reversed domain structure in the form of a wave guide is used conventionally.

Regarding the exposure system for green and red light-sensitive emulsion layers, use can be preferably made of a digital scanning exposure system using monochromatic high-density light such as a gas laser, light emitting diode, semiconductor laser, or second harmonic generating source (SHG) in which either a semiconductor laser or a solid-state laser using a semiconductor laser as an excitation source is combined with non-linear optical crystals. From a standpoint of realizing a compact and low-cost system, it is preferred to employ the semiconductor laser or the second harmonic generating source (SHG) in which the semiconductor laser or solid-state laser is combined with the non-linear optical crystals. In the viewpoint of designing a compact, affordable apparatus featuring longevity and high stability, the use of the semiconductor laser is particularly preferred, or the light source for exposure preferably employs at least one semiconductor laser. Specifically, lasers preferably used include a green laser having a wavelength of about 530 nm obtained by wavelength conversion of a semiconductor laser (oscillation wavelength: about 1,060 nm) by SHG crystals of $LiNbO_3$ having an inverted domain structure in the form of a waveguide, a red semiconductor laser having a wavelength of about 685 nm (Hitachi type No. HL6738MG), and a red semiconductor laser having a wavelength of about 650 nm (Hitachi type No. HL6501MG).

In the case of using these light sources for scanning exposure, the wavelength of the spectral sensitivity maximum provided by the light-sensitive material of the present invention can be set arbitrarily in accordance with the wavelength of the light source to be used. As an oscillation wavelength of a laser can be made half using a SHG light source comprising a combination of a nonlinear optical crystal with a solid state laser using a semiconductor laser as an excitation light source, or a semiconductor laser, a blue light and a green light can be obtained. Accordingly, the spectral sensitivity maximum of the light-sensitive material can be set in normal three wavelength regions of blue, green and red respectively.

The exposure time in such a scanning exposure is defined as a time required for exposing a pixel size with the pixel density being 400 dpi. A preferable exposure time is $10^{-4}$ second or less and more preferably $10^{-6}$ second or less.

For the light-sensitive material in the present invention, the imagewise exposure is preferably carried out with a coherent light. The term "coherent light" means light having predetermined optical phase characteristics and extremely excellent coherency. Typically, a laser beam oscillated from a laser is known to have coherent characteristics.

Using the compound, sensitizing dye, and light-sensitive silver halide of the present invention, it becomes possible to provide a light-sensitive material having a good ability of progressing development with negligible amounts of color residue and fogging. Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patent publications listed in the above Table are preferably used. Typically, processing is conducted using MINILABO "PP350" manufactured by Fuji Photo Film Co., Ltd. and CP48S CHEMICAL as the processing agent, and the light-sensitive material sample is exposed imagewise from a negative film at an average density and using a processing solution, conducting continuous processing till the volume of the color developing replenishing solution reaches twice the volume of the color development tank.

Here, the term "color developing time" means a period of time ranging from just after a light-sensitive material has entered into a developing solution to until the light-sensitive material has entered into a bleach-fixing solution at the subsequent processing step. For example, in a case where a processing is conducted using an automatic processor or the like, the total of a period of time when a light-sensitive material has been immersed in a developing solution (so-called "in-liquid time") and a period of time when after leaving from the developing solution, the light-sensitive material has been transferred toward a bleach-fixing bath at the subsequent processing step (so-called "in-air time") is designated as a color developing time. Likewise, the term "bleach-fixing time" means a period of time ranging from just after a light-sensitive material has entered into a bleach-fixing solution to until the light-sensitive material has entered into a washing or stabilizing bath at the subsequent processing step. Further, the term "washing or stabilizing time" means a period of time ranging from just after a light-sensitive material has entered into a washing or stabilizing solution to until the light-sensitive material has been in the solution toward the drying step (so-called "in-liquid time").

Namely, the present invention can be properly applied to a light-sensitive material with a rapid processing suitability. A color developing time is in the range of generally 50 sec. or less, preferably 28 sec. to 6 sec., and more preferably in the range of 20 sec. to 6 sec. Likewise, a bleach-fixing time is preferably 30 sec. or less, more preferably in the range of 25 sec. to 6 sec., and further more preferably in the range of 20 sec. to 6 sec. A washing or stabilizing time is preferably 60 sec. or less, and more preferably in the range of 40 sec. to 6 sec.

Examples of a development method applicable to the light-sensitive material for use in the present invention after exposure, include a conventional wet system, such as a development method using a developing solution containing an alkali agent and a developing agent, and a development method wherein a developing agent is incorporated in the light-sensitive material and an activator solution, e.g., a developing agent-free alkaline solution is employed for the development, as well as a heat development system using no processing solution. In particular, the activator method is preferred over the other methods, because the processing solutions contain no developing agent, thereby it enables easy management and handling of the processing solutions and reduction in waste disposal load to make for environmental preservation.

The preferable developing agents or their precursors incorporated in the light-sensitive materials in the case of adopting the activator method include the hydrazine compounds described in, for example, JP-A-8-234388, JP-A-9-152686, JP-A-9-152693, JP-A-9-211814 and JP-A-9-160193.

Further, the processing method in which the light-sensitive material reduced in the amount of silver to be applied undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to light-sensitive materials having a reduced silver amount. In such a case, washing or stabilization processing can follow the processing with an activator solution to result in simplification of the processing process. On the other hand, when the system of reading the image information from light-sensitive materials by means of a scanner or the like is employed, the processing form requiring no desilvering step can be applied, even if the light-sensitive materials are those having a high silver amount, such as light-sensitive materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536–541 (September 1994), and JP-A-8-234388 can be used in the present invention.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patent publications listed in the above Table are preferably used.

Typically, processing is conducted using MINILABO "PP350" manufactured by Fuji Photo Film Co., Ltd. and CP48S CHEMICAL as the processing agent, and the light-sensitive material sample is exposed imagewise from a negative film at an average density and using a processing solution, conducting continuous processing till the volume of the color developing replenishing solution reaches twice the volume of the color development tank.

Chemicals for the processing agent may be CP45X and CP47L manufactured by Fuji Photo Film Co., Ltd.; RA-100 and RA-4 manufactured by Eastman Kodak Co., Ltd., and so on.

As cyan, magenta and yellow couplers which can be used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right lower column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it may be and is preferred for the present invention to add compounds represented by formula (II) or (III) in WO 98/33760 and compounds represented by formula (D) described in JP-A-10-221825.

As the cyan dye-forming coupler (hereinafter also referred to as "cyan coupler") which can be used in the present invention, pyrrolotriazole-series couplers are preferably used, and more specifically, couplers represented by any of formulae (I) and (II) in JP-A-5-313324 and couplers represented by formula (I) in JP-A-6-347960 are preferred.

Exemplified couplers described in these publications are particularly preferred. Further, phenol-series or naphthol-series cyan couplers are also preferred. For example, cyan couplers represented by formula (ADF) described in JP-A-10-333297 are preferred. As cyan couplers other than the foregoing cyan couplers, there are pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, the cyan dye-forming coupler according to the present invention can also be a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in EP 0333185 A2; a cyclic active methylene-series cyan coupler (particularly couplers 3, 8, and 34 enumerated as specific examples are particularly preferable) described in JP-A-64-32260; a pyrrolopyrazole cyan coupler described in European Patent No. 0456226 A1; and a pyrroloimidazole cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated in the present specification by reference.

The magenta dye-forming couplers (which may be referred to simply as a "magenta coupler" hereinafter) that can be used in the present invention are 5-pyrazolone magenta couplers and pyrazoloazole magenta couplers such as those described in the above-mentioned patent publications in Table 1. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 0226849 A2 and 0294785 A, in view of the hue and stability of image to be formed therefrom and color-forming property of the couplers. Particularly as the magenta coupler, pyrazoloazole couplers represented by formula (M-I) described in JP-A-8-122984 are preferred. The descriptions of paragraph Nos. 0009 to 0026 of the patent publication JP-A-8-122984 are entirely applied to the present invention and therefore are incorporated in the specification of this application as a part thereof by reference. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as a "yellow coupler" hereinafter), preferably used in the present invention are acylacetamide yellow couplers in which the acyl group has a 3-membered to 5-membered cyclic structure, such as those described in European Patent No. 0447969 A1; malondianilide yellow couplers having a cyclic structure, as described in European Patent No. 0482552 A1; pyrrol-2 or 3-yl or indol-2 or 3-yl carbonyl acetic acid anilide-series couplers, as described in European Patent (laid open to public) Nos. 953870 A1, 953871 A1, 953872 A1, 953873 A1, 953874 A1 and 953875 A1; acylacetamide yellow couplers having a dioxane structure such as those described in U.S. Pat. No. 5,118,599, in addition to the compounds described in the above-mentioned table. Above all, a compound represented by the following formula (S) is especially preferably used:

Formula (S)

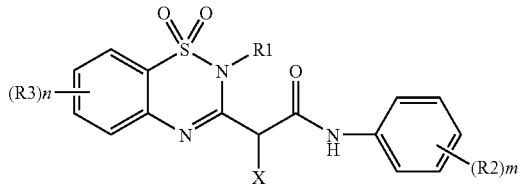

wherein R1, R2 and R3 each independently represent a substituent; m represents an integer of 0 (zero) to 5; when m is 2 or more, R2s may be the same or different from each other, or R2s may bond each other to form a ring; n represents an integer of 0 (zero) to 4; when n is 2 or more, R3s may be the same or different, or R3s may bond each other to form a ring; and X represents a hydrogen atom, or a group capable of being split-off upon a coupling reaction with an oxidized product of a developing agent.

In formula (S), R1 represents a substituent excepting a hydrogen atom. Examples of the substituent include halogen atoms, alkyl (including cycloalkyl and bicycloalkyl), alkenyl (including cycloalkenyl and bicycloalkenyl), alkynyl, aryl, heterocyclic, cyano, hydroxyl, nitro, carboxyl, alkoxy, aryloxy, silyloxy, heterocyclic oxy, acyloxy, carbamoyloxy, alkoxycarbonyloxy, aryloxycarbonyloxy, amino (including alkylamino and anilino), acylamino, aminocarbonylamino, alkoxycarbonylamino, aryloxycarbonylamino, sulfamoylamino, alkyl- or aryl-sulfonylamino, mercapto, alkylthio, arylthio, heterocyclic thio, sulfamoyl, sulfo, alkyl- or aryl-sulfinyl, alkyl- or aryl-sulfonyl, acyl, aryloxycarbonyl, alkoxycarbonyl, carbamoyl, arylazo or heterocyclicazo, imido, phosphio, phosphinyl, phosphinyloxy, phosphinylamino, and silyl groups.

R2 represents a substituent other than a hydrogen atom. Examples of the substituent include those atoms and groups exemplified as the substituent of the above-mentioned R1. R2 is preferably a halogen atom (i.e., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetoamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulamoyl, N,N-diethylsulfamoyl), an alkylsulfonyl group (e.g., methane sulfonyl), an arylsulfonyl group (e.g., benzene sulfonyl), an alkylthio group (e.g., methylthio, dodecylthio), an arylthio group (e.g., phenylthio, naphthylthio), a cyano group, a carboxyl group and a sulfo group. At least one of $R_2$ that is at the ortho position to the —CONH— group is preferably a halogen atom, an alkoxy group, an aryloxy group, an alkyl group, an alkylthio group and an arylthio group. More preferable is the alkylthio group or the arylthio group, and still more preferable is the alkylthio group (preferably a primary alkylthio group or a tertiary alkylthio group, more preferably the primary alkylthio group, still more preferably the primary alkylthio group branched at the β-position, most preferably a 2-ethylhexylthio group). Furthermore, preferable is one having at least one of R2 in the ortho position with respect to the —CONH— group described above and another R2 in the para position of the ortho position, and further preferable is one in which R2 in the para position is an alkyl group (preferably a tertiary alkyl group, more preferably a t-butyl group). Most preferable is one in which R2 has a 2-ethylhexylthio group in the second position and a t-butyl group in the fifth position with respect to the —CONH— group.

The total carbon atom of R2 is preferably in the range of 0 (zero) to 60, more preferably in the range of 0 (zero) to 50, furthermore preferably in the range of 0 (zero) to 40.

Furthermore, m denotes the integral number of 0 to 5. When m is 2 or more, plural R2 may be identical with or different from each other, and they may be linked together to form a ring. Preferably, m is 1 or 3, more preferably m is 1 to 2, and most preferably m is 2.

R3 represents a substituent. Examples of the substituent include those atoms and groups exemplified as the substituent of the above-mentioned R1. R3 is preferably a halogen atom (i.e., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetoamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulfamoyl, N,N-diethylsulfamoyl), an alkylsulfonyl group (e.g., methane sulfonyl), an arylsulfonyl group (e.g., benzene sulfonyl), a cyano group, a carboxyl group and a sulfo group.

n represents an integer of 0 or more and 4 or less. When n is 2 or more, a plurality of R2 may be the same or different, or they may combine together to form a ring.

X represents a hydrogen atom or a group that can be split-off upon a coupling reaction with an oxidized product of a developing agent. In the present invention, X is preferably the group that can be split-off upon a coupling reaction with an oxidized product of a developing agent.

Examples of the above-described group capable of being split-off upon a coupling reaction with an oxidized product of a developing agent include a group capable of being split-off with a nitrogen, oxygen, or sulfur atom (a splitting-off atom), and a halogen atom (e.g., chlorine, bromine).

Examples of the group that splits off with a nitrogen atom include a heterocyclic group (preferably 5- to 7-membered substituted or unsubstituted saturated or unsaturated aromatic (herein the term "aromatic" is used to embrace a substance that has (4n+2) cyclic conjugated electrons) or non-aromatic, monocyclic or condensed heterocyclic groups, more preferably 5- or 6-membered heterocyclic groups, in which the ring-forming atoms are selected from carbon, oxygen, nitrogen and sulfur atoms and in addition at least one of hetero atoms selected from nitrogen, oxygen and sulfur atoms is incorporated, with specific examples of the heterocyclic ring including succinimide, maleinimide, phthalimide, diglycolimide, pyrrole, pyrazole, imidazole, 1,2,3-triazole, 1,2,4-triazole, tetrazole, indole, benzopyrazole, benzimidazole, benzotriazole, imidazoline-2,4-dione, oxazolidine-2,4-dione, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine-4-one), a carbonamido group (e.g., acetamido, trifluoroacetamido), a sulfonamido group (e.g., methanesulfonamido, benzenesulfonamido), an arylazo group (e.g., phenylazo, naphthylazo), and a carbamoylamino group (e.g., N-methyl carbamoylamino).

Preferred of the group that splits off with a nitrogen atom are heterocyclic groups, more preferably aromatic heterocyclic groups having 1, 2, 3 or 4 ring-forming nitrogen atoms or heterocyclic groups represented by the following formula (L):

Formula (L)

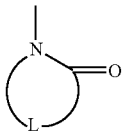

wherein L represents a moiety that forms a 5- to 6-membered nitrogen-containing heterocycle with —NC(═O)—.

Examples of the moieties are enumerated in the explanation of the above-mentioned heterocyclic group, and such moieties as enumerated above are more preferred.

Particularly preferably L is a moiety that forms a 5-membered nitrogen-containing heterocyclic ring.

Among the groups capable of desorption by a nitrogen atom, more preferable groups include imidazolidin-2,4-dione, oxazolidin-2,4-dione, imidazole, and pyrazole which may have substituents, and most preferable is a 5,5-dimethyloxazolidin-2,4-dion-3-yl group.

Examples of the group that splits off with an oxygen atom include an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbamoyloxy), an aryloxycarbonyloxy group (e.g., phenoxycarbonyloxy), an alkoxycarbonyloxy group (e.g., methoxycarbonyloxy, ethoxycarbonyloxy), an alkylsulfonyloxy group (e.g., methanesulfonyloxy), and an aryl sulfonyloxy group (e.g., benzenesulfonyloxy, toluenesulfonyloxy).

Preferred of these groups capable of being spilt-off at the moiety of oxygen atom are an aryloxy group, an acyloxy group and a heterocyclic oxy group.

Examples of the group that splits off with a sulfur atom include an arylthio group (e.g., phenylthio, naphthylthio), a heterocyclic thio group (e.g., tetrazolylthio, 1,3,4-thiadiazolylthio, 1,3,4-oxazolylthio, benzimidazolyl thio), an alkylthio group (e.g., methylthio, octylthio, hexadecylthio), an alkylsulfinyl group (e.g., methane sulfinyl), an arylsulfinyl group (e.g., benzenesulfinyl), an arylsulfonyl group (e.g., benzenesulfonyl), and an alkylsulfonyl group (e.g., methansulfonyl).

Preferred of the group that splits off with a sulfur atom are an arylthio group and a heterocyclic thio group. A heterocyclic thio group is more preferred.

X may be substituted with a substituent. Examples of the substituent include those atoms and groups exemplified as the substituent of the above-mentioned $R_1$.

X is preferably a group that can split off through a coupling reaction with the oxidized product of a color-developing agent. Among these splitting-off groups, preferred are groups that can split off with a nitrogen atom, an oxygen atom or a sulfur atom. More preferably the splitting-off group is a group that can split off with a nitrogen atom. Furthermore, the splitting-off group is preferred in the same preferable order as mentioned about the group that can split off with a nitrogen atom.

X may be a photographically useful group. Examples of the photographically useful group include a development inhibitor, a desilvering accelerator, a redox compounds, a dye, a coupler and precursors of these compounds.

Among the dye-forming couplers represented by the formula (S), one represented by the following formula (T) is particularly preferable.

Formula (T)

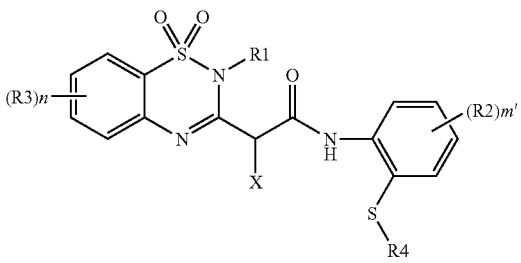

In the formula (T), R1, R2, R3, n, and X and their preferable ranges are the same as those represented by the formula (S).

R4 represents an alkyl group, m' represents an integer of 0 (zero) to 4. When m' is 2 or more, plural R2 may be identical with or different from each other and they may be linked together to form a ring. Furthermore, m' is preferably 0 (zero) to 2, more preferably 0 (zero) to 1, most preferably 1.

The alkyl group of R4 may have a substituent. Examples of such a substituent include those exemplified as the substituent of R1 described above. The substituent is preferably an alkyl group or an aryl group, more preferably the alkyl group. The alkyl group of R4 is preferably a primary alkyl group or a tertiary alkyl group, more preferably the primary alkyl group, more preferably the primary alkyl group branched at the β-position, most preferably a 2-ethylhexyl group.

Furthermore, the total number of carbon atoms including the substituent of R4 is preferably 1 to 30, more preferably 3 to 30, still more preferably 3 to 20, most preferably 4 to 12.

For immobilizing a coupler in the light-sensitive material, at least one of Q, R1, R2, R3, R4, and X has 7 to 50, more preferably 8 to 40 carbon atoms in total including the substituent.

Hereinafter, preferable specific examples of a yellow dye forming coupler represented by one of the formulae (S) and (T) are listed. However, the present invention is not limited to those examples. Furthermore, the present invention also includes a tautomer in which a hydrogen atom at the coupling position is shifted on a nitrogen atom in the C═N portion bound to the coupling position.

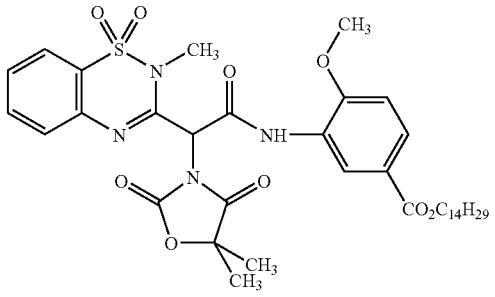

(1)

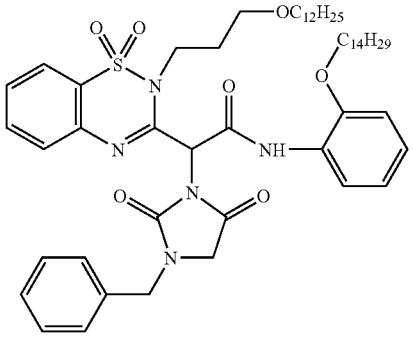

(2)

-continued
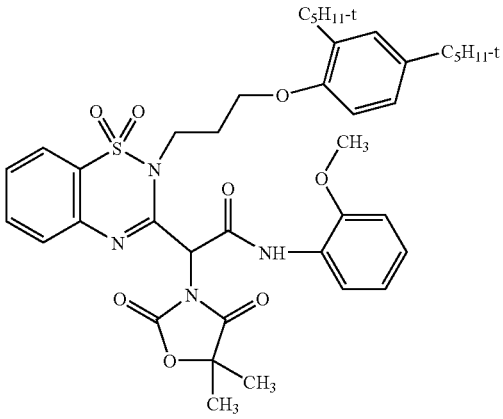
(3)
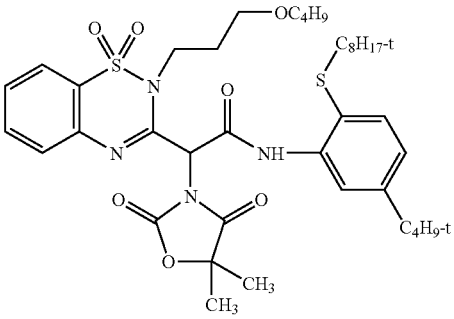
(4)
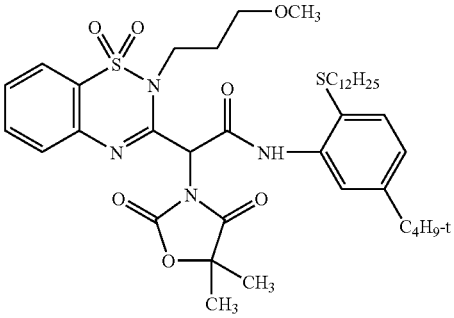
(5)
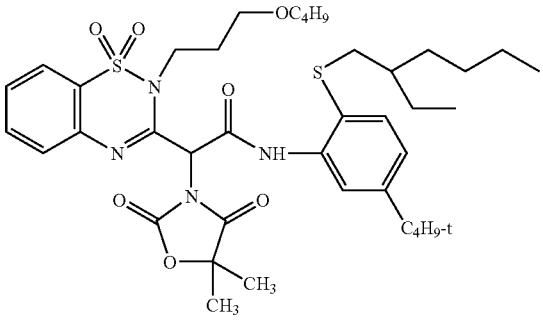
(6)
-continued
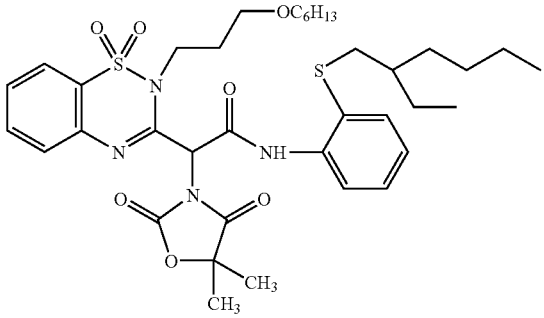
(7)
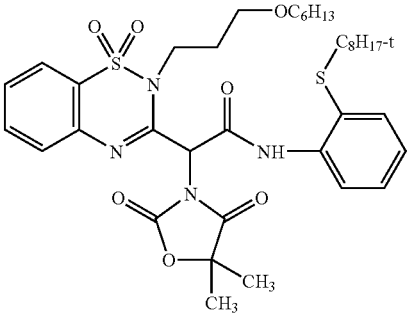
(8)
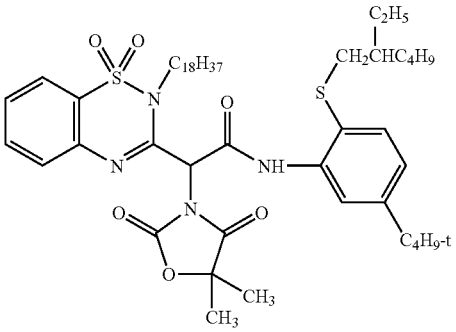
(9)
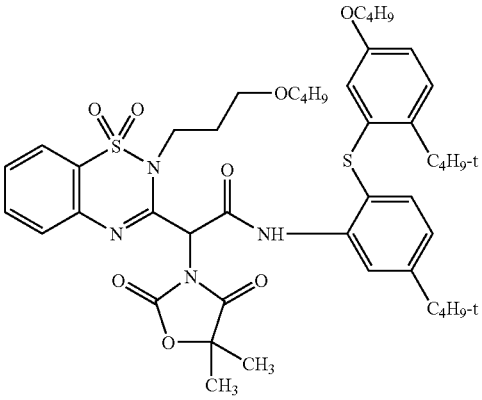
(10)

-continued

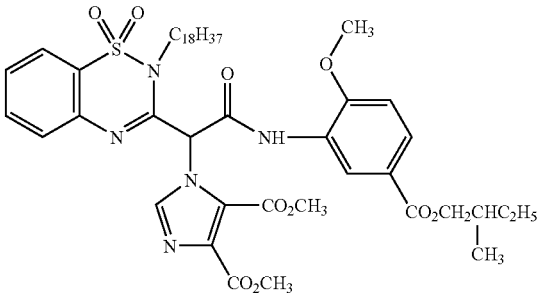

(11)

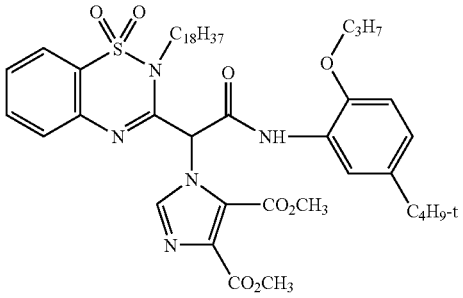

(12)

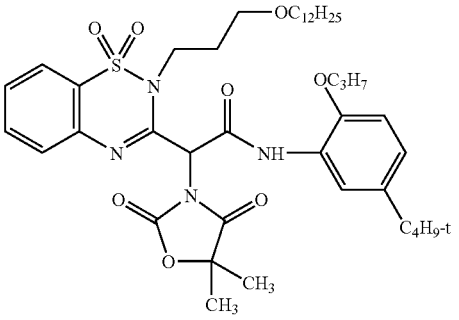

(13)

The yellow dye-forming coupler represented by the formula (S) or (T) may be easily synthesized according to the method described in EP-A-1246006 or a similar method thereto.

It is preferred that couplers for use in the present invention, are pregnated into a loadable latex polymer (as described, for example, in U.S. Pat. No. 4,203,716) in the presence (or absence) of the high-boiling-point organic solvent described in the Table 1, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic solvent-soluble polymer which can be preferably used, include the homopolymers and co-polymers as disclosed in U.S. Pat. No. 4,857,449, from column 7 to column 15 and WO 88/00723, from page 12 to page 30. The use of methacrylate-series or acrylamide-series polymers, especially acrylamide-series polymers are more preferable in view of color-image stabilization and the like.

Preferred examples of silver halide emulsions and other materials (additives or the like) for use in the present invention, photographic constitutional layers (arrangement of the layers or the like), and processing methods for processing the light-sensitive materials and additives for processing are disclosed in JP-A-62-215272, JP-A-2-33144 and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

In particular, as the above-described reflective support and silver halide emulsion, as well as the different kinds of metal ions to be doped in the silver halide grains, the storage stabilizers or antifogging agents of the silver halide emulsion, and an anti-fogging agent, the methods of chemical sensitization (sensitizers), the methods of spectral sensitization (spectral sensitizers), the cyan, magenta, and yellow couplers and the emulsifying and dispersing methods thereof, the dye image stability-improving agents (stain inhibitors and discoloration inhibitors), the dyes (colored layers), the kinds of gelatin, the layer structure of the light-sensitive material, and the film pH of the light-sensitive material, those described in the patent publications as shown in the following Table 1 are particularly preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |

TABLE 1-continued

| Element | JP-A-7-104448 | JP-A-7-77775 | JP-A-7-301895 |
|---|---|---|---|
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coated film of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

Hereinbelow, the present invention will be described in more detail with reference to working examples, but the present invention is not limited to those examples.

EXAMPLES

Example 1

(Preparation of Blue Sensitive Emulsion B-H1)

High silver chloride cubic grains were prepared by the process of simultaneously adding both silver nitrate and sodium chloride to deionized distilled water that contains deionized gelatin after being stirred. During the process of such a preparation, potassium bromide was added at a concentration of 1.5 mol % per mol of the yield of silver halide during the time period between the instant when the addition of silver nitrate was completed up to 85% and the instant when the addition of silver nitrate was completed up to 95%. Then, $K_4[Fe(CN)_6]$ in an amount of $4\times10^{-6}$ mol per mol of silver, $K_4[Ru(CN)_6]$ in an amount of $6\times10^{-6}$ mol per mol of silver, $K_2[Ir(5\text{-methylthiazole})Cl_5]$ in an amount of $5\times10^{-8}$ mol per mol of silver, $K_2[RhBr_5(H_2O)]$ in an amount of $3\times10^{9}$ mol per mol of silver, and $K_2[OsCl_5(NO)]$ in an amount of $4\times10^{-9}$ mol per mol of silver were added during the time period between the instant when the addition of silver nitrate was completed up to 80% and the instant when the addition of silver nitrate was completed up to 90%. Furthermore, $K_2[IrCl_5(H_2O)]$ in an amount of $8\times10^{-6}$ mol per mol of Silver and $K[IrCl_5(H_2O)_2]$ in an amount of $1\times10^{-6}$ mol per mol of silver were added during the time period between the instant when the addition of silver nitrate was completed up to 92% and the instant when the addition of silver nitrate was completed up to 98%. Furthermore, at the instant when the addition of silver nitrate was completed up to 90%, a potassium iodide solution was added while strongly stirred such that the amount of iodine reached to 0.27 mol % per mol of the yield of silver halide. The resulting emulsion grains were monodispersed cubic silver iodobromochloride grains having 0.54 μm in side length and 8.5% in variation coefficient. Subsequently, the emulsion was subjected to precipitation dechlorination, and then gelatin, compounds Ab-1, Ab-2, and Ab-3, and calcium nitrate were added to the emulsion, followed by redispersion.

(Ab-1) Antiseptic

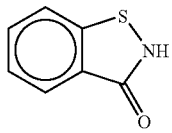

(Ab-2) Antiseptic

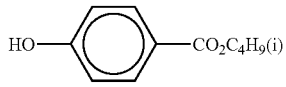

(Ab-3) Antiseptic

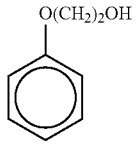

The redispersed emulsion was dissolved at 40° C., and then the emulsion was ripened with the addition of benzene sodium thiosulfate in an amount of $2\times10^{-5}$ mol per mol of silver, triethylthio urea as a sulfur sensitizing agent in an amount of $2\times10^{-6}$ mol per mol of silver, and Compound-1 as a gold sensitizing agent in an amount of $3\times10^{-5}$ mol per mol of silver so as to optimize post ripeing. After that, 1-(5-methylureide phenyl)-5-mercaptotetrazole in an amount of $2\times10^{-4}$ mol per mol of silver, Compound-2 in an amount of $8\times10^{-6}$ mol per mol of silver, Compound-3 in an amount of $1\times10^{-5}$ mol per mol of silver, and potassium bromide in an amount of $2\times10^{-3}$ mol per mol of silver were added to the emulsion. Furthermore, during the process of preparing the emulsion, as a sensitizing dye, sensitizing dye Dye-1 in an amount of $6\times10^{-4}$ mol per mol of silver was added for spectrally sensitizing the emulsion. The emulsion thus obtained was referred to as an emulsion B-H1.

Compaund-1

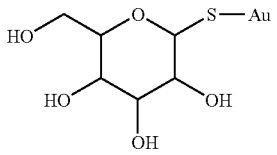

Compaund-2

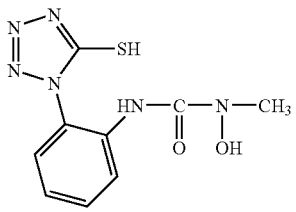

Compaund-3

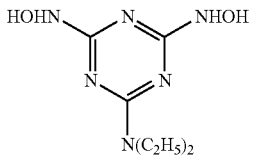

-continued

Sensitizing DYE-1

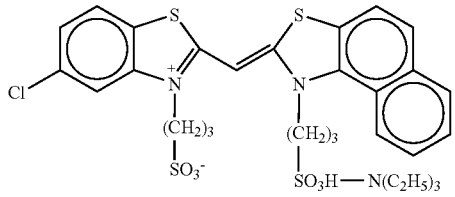

(Preparation of Blue Sensitive Emulsion B-L1)

Emulsion grains were obtained in the same way as that of the preparation of the emulsion B-H1 except that the temperature and the addition rate in the process of mixing silver nitrate and sodium chloride by simultaneous addition thereof were changed and the amounts of various metal complexes added in the middle of the addition of silver nitrate and sodium chloride were changed. The resulting emulsion grains were monodispersed cubic silver iodobromochloride grains having 0.34 μm in side length and 9.5% in variation coefficient. Subsequently, the emulsion B-L1 was prepared in the same way as that of the preparation of B-H1 except that the amounts of various compounds added were changed from those of the emulsion B-H1 after the redispersion of the emulsion.

(Preparation of Green Sensitive Emulsion G-H)

Emulsion grains were prepared in the same way as that of the preparation of the blue sensitive emulsion. The resulting emulsion grains were monodispersed cubic silver iodobromochloride grains having 0.48 μm in side length and 8.0% in variation coefficient. The emulsion was subjected to precipitation dechlorination, followed by redispersion.

Sensitizing Dye-2

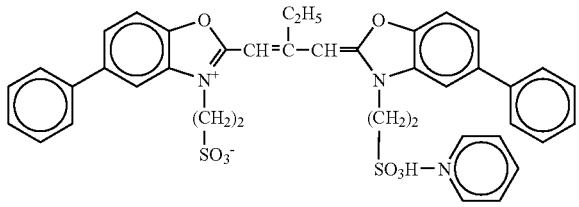

Sensitizing Dye-3

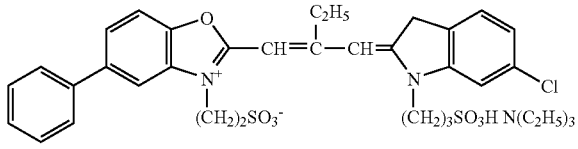

-continued

Sensitizing Dye-4

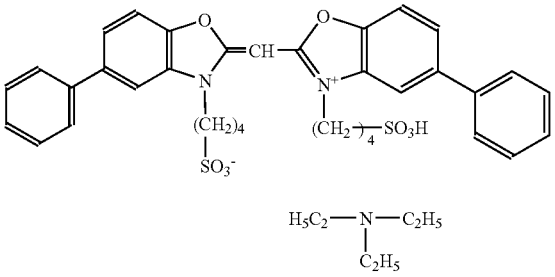

Sensitizing Dye-5

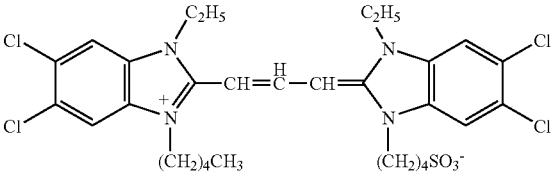

The redispersed emulsion was dissolved at 40° C., and then the emulsion was ripened with the addition of benzene sodium thiosulfate, p-glutaramide phenyldisulfide, sodium thiosulfate penta-hydrate as a sulfur sensitizing agent, and (bis-(1,4,5-trimethyl-1,2,4-triazolium-3-thiolate) aurate (I) tetrafluoroborate) as a gold sensitizing agent were added to optimize post ripening. After that, 1-(3-acetoamidephenyl)-5-mercaptotetrazole, 1-(5-methylureidephenyl)-5-mercaptotetrazole, Compound-2, Compound-3, and potassium bromide were added. Furthermore, as sensitizing dyes, Dye-2 to Dye-5 were added in the middle of the process of preparing the emulsion to spectrally sensitize the emulsion. The emulsion thus obtained was referred to as an emulsion G-H.

(Preparation of Green Sensitive Emulsion G-L)

Emulsion grains were obtained in the same way as that of the preparation of the emulsion G-H except that the temperature and the addition rate in the process of mixing silver nitrate and sodium chloride by simultaneous addition thereof were changed and the amounts of various metal complexes added in the middle of the addition of silver nitrate and sodium chloride were changed. The resulting emulsion grains were monodispersed cubic silver iodobromochloride grains having 0.25 μm in side length and 9.8% in variation coefficient. Subsequently, the emulsion G-L was prepared in the same way as that of the preparation of G-H except that the amounts of various compounds added were changed from those of the emulsion G-H after the redispersion of the emulsion.

(Preparation of Red Sensitive Emulsion R-H)

High silver chloride cubic grains were prepared by the process of simultaneously adding both silver nitrate and sodium chloride to deionized distilled water that contains deionized gelatin after being stirred. During the process of such a preparation, potassium bromide was added at a concentration of 2.5 mol % per mol of the yield of silver halide during the time period between the instant when the addition of silver nitrate was completed up to 65% and the instant when the addition of silver nitrate was completed up to 90%. Then, $K_4[Fe(CN)_6]$, $K_4[Ru(CN)_6]$, $K_2[Ir(5\text{-methylthiazole})Cl_5]$, $K_3[RhBr_6]$, and $K_2[RuCl_5(NO)]$ were added during the time period between the instant when the addition of silver nitrate was completed up to 70% and the instant when the addition of silver nitrate was completed up to 85%. Furthermore, $K_2[IrCl_5(H_2O)]$ was added during the time period between the instant when the addition of silver nitrate was completed up to 85% and the instant when the addition of silver nitrate was completed up to 98%. Furthermore, at the instant when the addition of silver nitrate was completed up to 88%, a potassium iodide solution was added while strongly stirred such that the amount of iodine reached to 0.15 mol % per mol of the yield of silver halide. The resulting emulsion grains were monodispersed cubic silver iodobromochloride grains having 0.39 μm in side length and 10% in variation coefficient. Subsequently, the resultant emulsion was subjected to precipitation dechlorination, followed by redispersion, in the same manner as mentioned above.

The redispersed emulsion was dissolved at 40° C., and then the emulsion was ripened with the addition of the sensitizing dye-6, Compound-6, and triethylthio urea, as a sulfur sensitizing agent, and Compound-1 as a gold sensitizing agent were added to optimize post ripening. After that, 1-(3-acetoamidephenyl)-5-mercaptotetrazole, 1-(5-methylureidephenyl)-5-mercaptotetrazole, Compound-2, and Compound-3 were added. The emulsion thus obtained was referred to as an emulsion R-H.

(Sensitizing Dye-6)

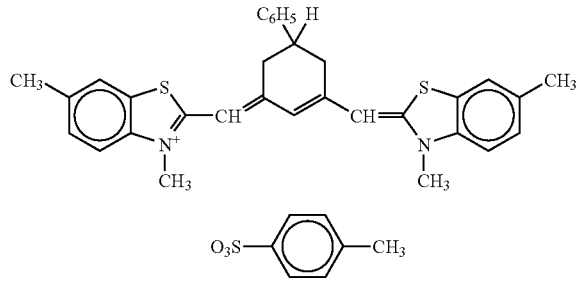

(Compound-4)

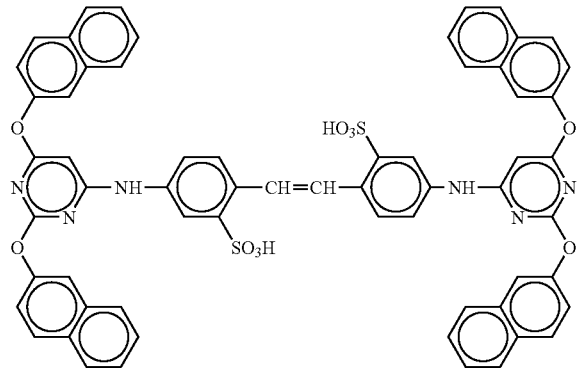

(Preparation of Red Sensitive Emulsion R-L)

Emulsion grains were obtained in the same way as that of the preparation of the emulsion R-H except that the temperature and the addition rate in the process of mixing silver nitrate and sodium chloride by simultaneous addition thereof were changed and the amounts of various metal complexes added in the middle of the addition of silver nitrate and sodium chloride were changed. The resulting emulsion grains were monodispersed cubic silver iodobromochloride grains having 0.29 μm in side length and 9.9% in variation coefficient. Subsequently, the resultant emulsion was subjected to precipitation dechlorination, followed by redispersion. The emulsion R-L was prepared in the same way as that of the preparation of R-H except that the amounts of various compounds added were changed from those of the emulsion R-H after the redispersion of the emulsion.

(Preparation of a Coating Solution for the First Layer)

Into 23 g of a solvent (Solv-4), 4 g of a solvent (Solv-6), 23 g of a solvent (Solv-9) and 60 ml of ethyl acetate were dissolved 34.0 g of a yellow coupler (Ex-Y), 1.0 g of a color-image stabilizer (Cpd-1), 1.0 g of a color-image stabilizer (Cpd-2), 8.0 g of a color-image stabilizer (Cpd-8), 1.0 g of a color-image stabilizer (Cpd-18), 2.0 g of a color-image stabilizer (Cpd-19), 15.0 g of a color-image stabilizer (Cpd-20), 1.0 g of a color-image stabilizer (Cpd-21), 15 g of a color-image stabilizer (Cpd-23), 0.1 g of an additive (ExC-1), and 1.0 g of a color-image stabilizer (UV-2). This solution was emulsified and dispersed in 270 μg of a 20 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions B-H1 and B-L1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, and Ab-3, so that the total amounts would be 15.0 mg/m$^2$, 60.0 mg/m$^2$, 5.0 mg/m$^2$, and 10.0 mg/m$^2$, respectively.

(H-1) Hardener

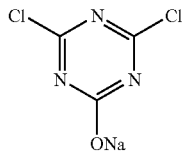

(H-2) Hardener

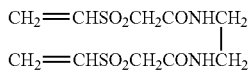

-continued (H-3) Hardener

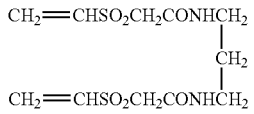

Further, to the second layer, the fourth layer, and the sixth layer, 1-(3-methylureidophenyl)-5-mercaptotetrazole was added in amounts of 0.25 mg/m$^2$, 0.15 mg/m$^2$, and 0.6 mg/m$^2$, respectively.

Furthermore, to the blue sensitive emulsion layer, the green sensitive emulsion layer and the red sensitive emulsion layer, 4-hydroxy-6-methyl-1,3,3a,7-tetrazaindene was added in amounts of $1\times10^{-4}$ mole, $2\times10^{-4}$ mole, $5\times10^{-5}$ mole per mole of the silver halide, respectively.

To the red-sensitive emulsion layer, was added a copolymer latex of methacrylic acid and butyl acrylate (1:1 in mass ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Then, to each layer, sodium polystyrenesulfonate was added as necessary to adjust the viscosity of the coating layer.

Further, to neutralize irradiation, the following dyes were added (the coating amount is shown in parentheses).

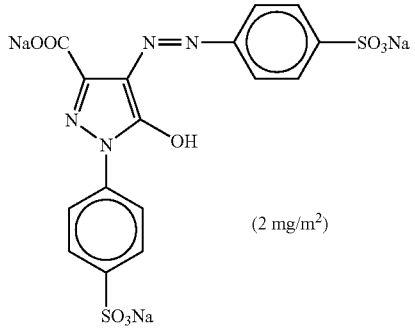

(2 mg/m$^2$)

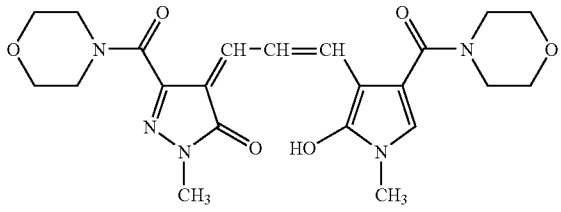

(2 mg/m$^2$)

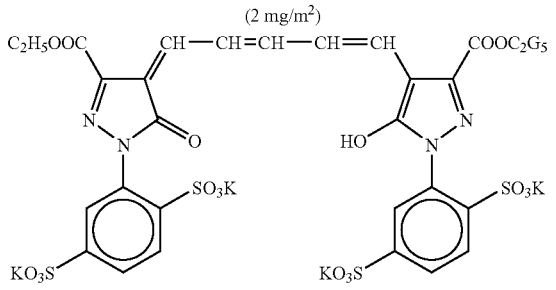

(24 mg/m$^2$)

-continued

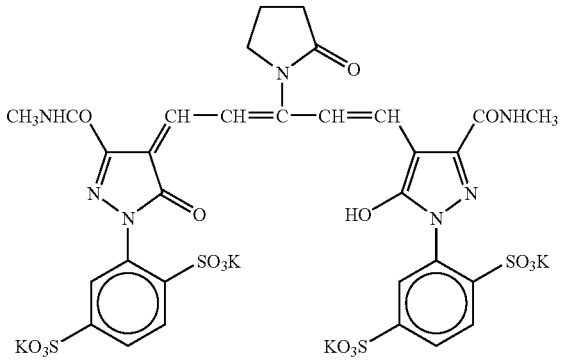

(3 mg/m$^2$)

(Layer Constitution)

The composition of each layer is shown below. The numbers show coating amounts (g/m$^2$). In the case of the silver halide emulsion, the coating amount is in terms of silver.

Support

Polyethylene Resin-Laminated Paper

[The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.30 mass %) and a bluish dye (ultramarine; content of 0.30 mass %) with the polyethylene resin amount of 29.2 g/m$^2$].

| First Layer (Blue-Sensitive Emulsion Layer) | |
|---|---|
| Silver iodobromochloride emulsion (gold-sulfur sensitized cubic form, a mixture in a ratio of 6:4 (Ag mole ratio) of a large grain size emulsion B-H1 and a small grain size emulsion B-L1 | 0.16 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.02 |
| Color-image stabilizer (Cpd-20) | 0.15 |
| Color-image stabilizer (Cpd-21) | 0.01 |
| Additive (ExC-1) | 0.001 |
| Color-image stabilizer (UV-2) | 0.01 |
| Solvent (Solv-4) | 0.23 |
| Solvent (Solv-6) | 0.04 |
| Solvent (Solv-9) | 0.23 |
| Second Layer (Color-Mixing Preventing Layer) | |
| Gelatin | 0.78 |
| Color-mixing inhibitor (Cpd-4) | 0.05 |
| Color-image stabilizer (Cpd-5) | 0.006 |
| Color-image stabilizer (Cpd-6) | 0.05 |
| Color-image stabilizer (Cpd-7) | 0.006 |
| Color-image stabilizer (Cpd-12) | 0.01 |
| Color-image stabilizer (UV-A) | 0.06 |
| Solvent (Solv-1) | 0.06 |
| Solvent (Solv-2) | 0.06 |
| Solvent (Solv-5) | 0.07 |
| Solvent (Solv-8) | 0.07 |

-continued

| Third Layer (Green-Sensitive Emulsion Layer) | |
|---|---|
| Silver iodobromochloride emulsion (gold-sulfur sensitized cubic form, a mixture in a ratio of 7:3 (Ag mole ratio) of a large grain size emulsion G-H and a small grain size emulsion G-L | 0.12 |
| Gelatin | 0.95 |
| Magenta coupler (ExM) | 0.12 |
| Ultraviolet absorbing agent (UV-A) | 0.03 |
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth Layer (Color-Mixing Preventing Layer) | |
| Gelatin | 0.65 |
| Color mixing-inhibitor (Cpd-4) | 0.045 |
| Color-image stabilizer (Cpd-5) | 0.005 |
| Color-image stabilizer (Cpd-6) | 0.04 |
| Color-image stabilizer (Cpd-7) | 0.005 |
| Color-image stabilizer (Cpd-12) | 0.008 |
| Color-image stabilizer (UV-A) | 0.05 |
| Solvent (Solv-1) | 0.05 |
| Solvent (Solv-2) | 0.05 |
| Solvent (Solv-5) | 0.06 |
| Solvent (Solv-8) | 0.06 |
| Fifth Layer (Red-Sensitive Emulsion Layer) | |
| Silver iodobromochloride emulsion (gold-sulfur sensitized cubic form, a mixture in a ratio of 3:7 (Ag mole ratio) of a large grain size emulsion R-H and a small grain size emulsion R-L | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.18 |
| Color-image stabilizer (Cpd-16) | 0.002 |
| Color-image stabilizer (Cpd-17) | 0.001 |
| Color-image stabilizer (Cpd-18) | 0.05 |
| Color-image stabilizer (Cpd-19) | 0.04 |
| Color-image stabilizer (UV-5) | 0.10 |
| Solvent (Solv-5) | 0.19 |
| Sixth Layer (Ultraviolet Absorbing Layer) | |
| Gelatin | 0.34 |
| Ultraviolet absorbing agent (UV-B) | 0.24 |
| Compound (S1-4) | 0.0015 |
| Solvent (Solv-7) | 0.11 |
| Seventh Layer (Protective Layer) | |
| Gelatin | 0.82 |
| Additive (Cpd-22) | 0.03 |

-continued
| | |
|---|---|
| Liquid paraffin | 0.02 |
| Surface-active agent (Cpd-13) | 0.02 |
(EX-Y) Yellow coupler
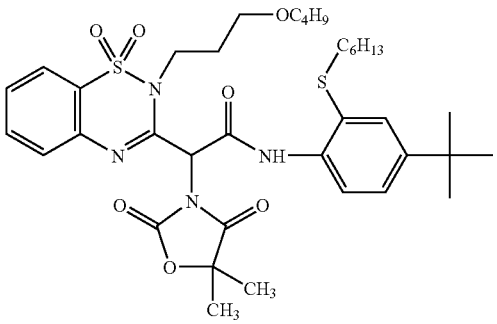
(ExM) Magenta coupler
Mixture of
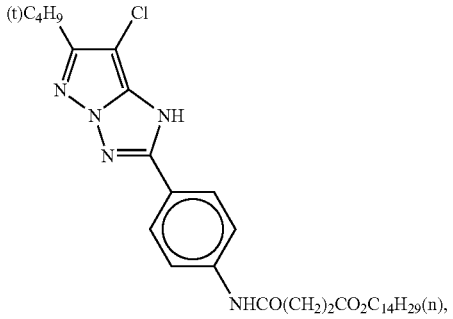
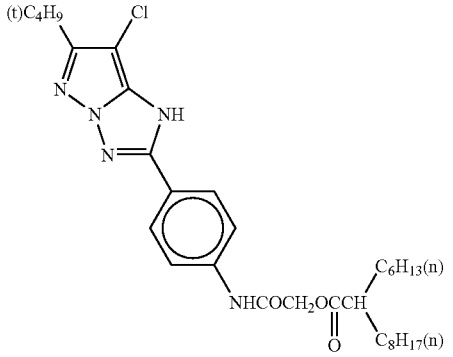
and
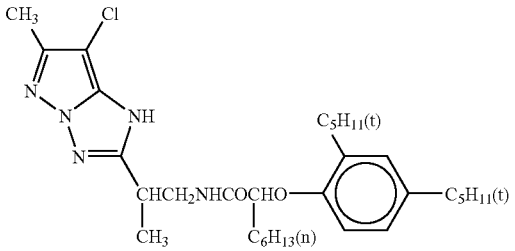
in molar ratio of 40:40:20.
-continued
(ExC-1) Cyan coupler
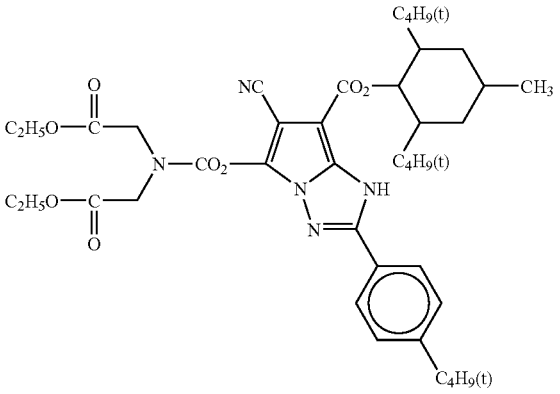
(ExC-2) Cyan coupler
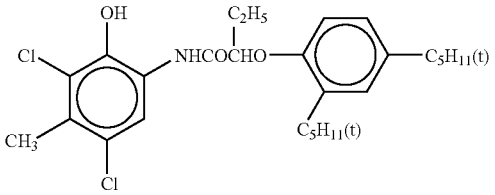
(ExC-3) Cyan coupler
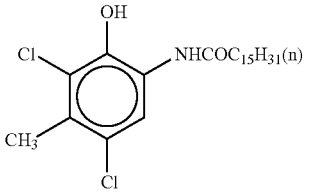
(Cpd-1) Color-image stabilizer
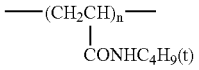
Number-average molecular weight 60,000
(Cpd-2) Color-image stabilizer
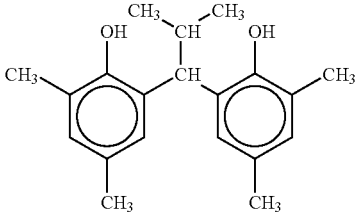
(Cpd-3) Color-image stabilizer
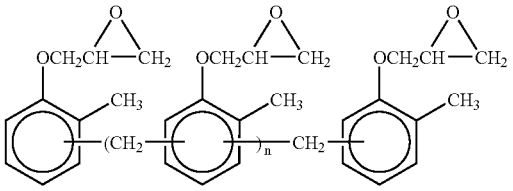
n = 7~8
(Average value)

-continued
(Cpd-4) Color-mixing inhibitor
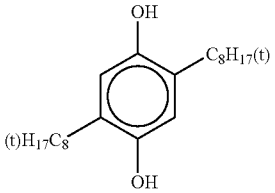
(Cpd-5) Color-image stabilizer
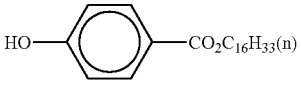
(Cpd-6) Color-image stabilizer
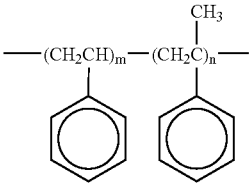
Number-average
molecular weight 600
m/n = 10/90
(Cpd-7) Color-image stabilizer
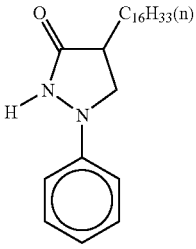
(Cpd-8) Color-image stabilizer
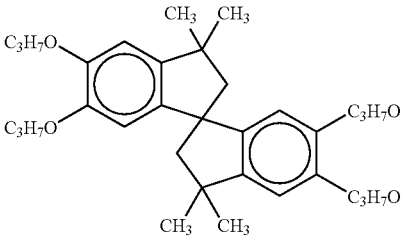
(Cpd-9) Color-image stabilizer
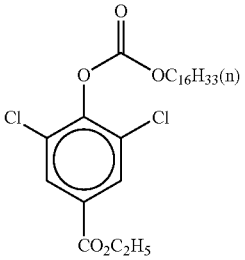
-continued
(Cpd-10) Color-image stabilizer
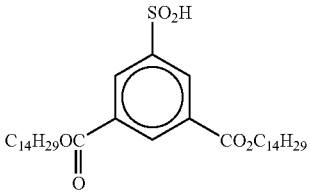
(Cpd-11)
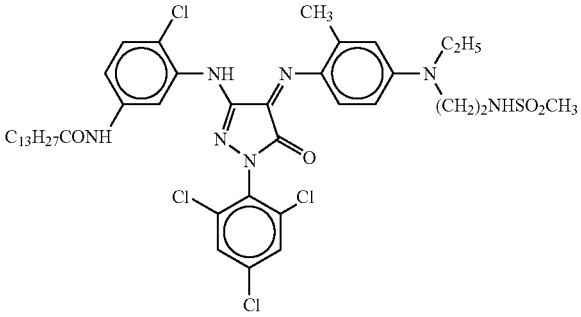
(Cpd-12)
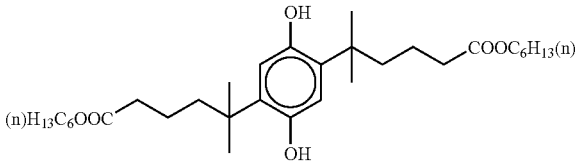
(Cpd-13) Surface active agent
Mixture of (a), (b) and (c) in molar ratio of 6:2:2
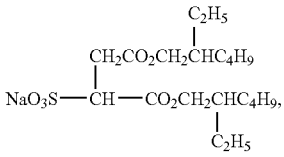
(a)
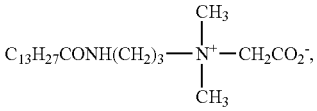
(b)
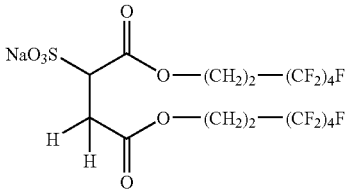
(c)

-continued
(Cpd-14)
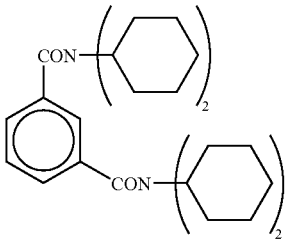
(Cpd-15)
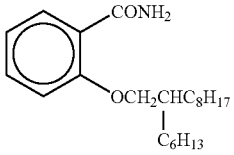
(Cpd-16)
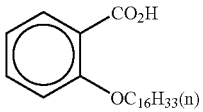
(Cpd-17)
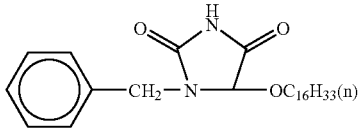
(Cpd-18)
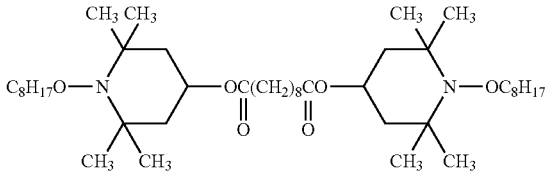
(Cpd-19)
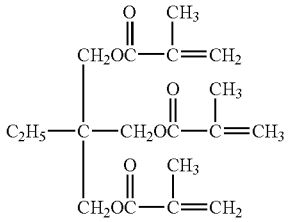
(Cpd-20)
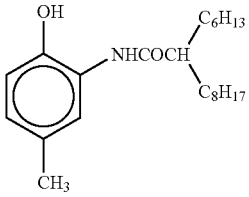
(Cpd-21)
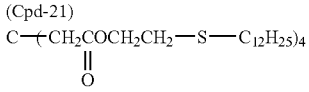
-continued
(Cpd-22)
x:y = 5:1 (mass ratio)
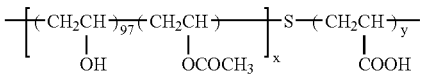
x:y = 5:1 (mass ratio)
(Cpd-23)
KAYARAD DPCA-30
manufacture by NIPPON KAYAKU CO., LTD.
(Solv-1)
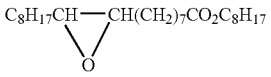
(Solv-2)
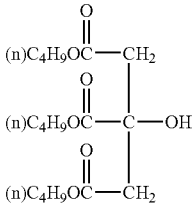
(Solv-3)
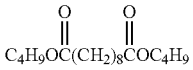
(Solv-4)
$O{=}P(OC_6H_{13}(n))_3$
(Solv-5)
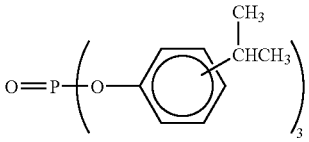
(Solv-6)
$C_8H_{17}CH{=}CHC_8H_{16}OH$
(Solv-7)
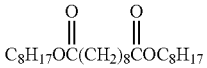
(Solv-8)
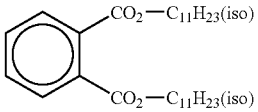
(Solv-9)
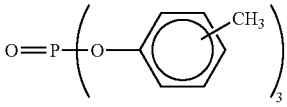
(S1-4)
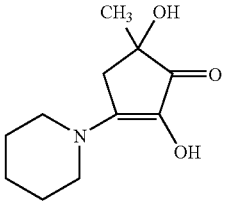

-continued (UV-1) Ultraviolet absorbing agent

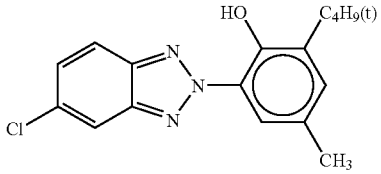

(UV-2) Ultraviolet absorbing agent

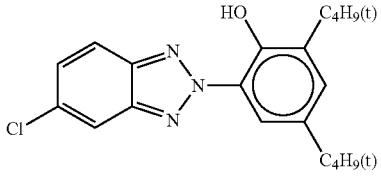

(UV-3) Ultraviolet absorbing agent

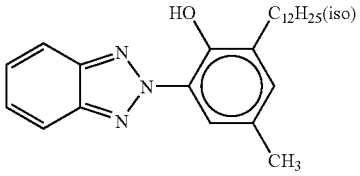

(UV-4) Ultraviolet absorbing agent

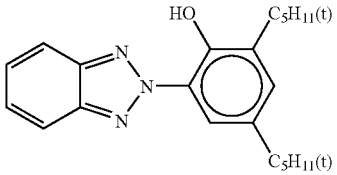

(UV-5) Ultraviolet absorbing agent

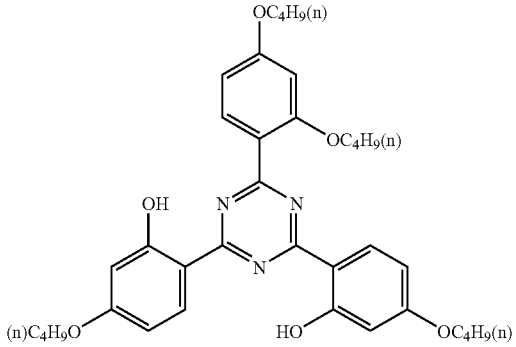

UV-A: Mixture of UV-1/UV-4/UV-5 in mass ratio of 1/7/2
UV-B: Mixture of UV-1/UV-3/UV-4/UV-5 in mass ratio of 1/3/5/1

As described above, a coating sample 101 was prepared. Subsequently, samples 104, 107, and 115 were prepared in the same way as that of the process of preparing the emulsions B-H1 and B-L1 in the first layer except that equimolar amounts of S-38, S-12, and S-2 were respectively used instead of Dye-1 relative to the sample 101. Samples 102, 103, 105, 106, 108 to 114, and 116 were prepared in the same way with the exception that compounds described below were added at a concentration of 30 mg per mol of silver halide in the first layer relative to the samples 101, 104, 107, and 115, respectively. Each sample was subjected to the following evaluation after a storage period of 7 days at a temperature of 25° C. and a relative humidity of 60% after coating the light-sensitive material.

The foregoing light-sensitive material 101 was made into a roll having a width of 127 mm. The resulting roll (light-sensitive material) was exposed to light image-wise of an ordinary photographic image, using with a laboratory processor in which a digital Mini-lab Frontier 350 (trade name, manufactured by Fuji Photo Film Co., Ltd.) was remodeled, and then processed continuously (running processing) according to the processing steps mentioned below, until the amount of the replenisher to the color developer tank became 1.5 times the capacity of the color developer tank. The processing in which the resulting running solution was used, was designated as "processing A".

| Processing Step | Temperature | Time | Replenishing rate* |
|---|---|---|---|
| Color Development | 38.5° C. | 45 sec. | 45 ml |
| Bleach-fixing | 38.0° C. | 45 sec. | 35 ml |
| Rinse (1) | 38.0° C. | 20 sec. | — |
| Rinse (2) | 38.0° C. | 20 sec. | — |
| Rinse (3)** | 38.0° C. | 20 sec. | — |
| Rinse (4)** | 38.0° C. | 30 sec. | 121 ml |
| Dry | 80° C. | | |

*The replenishment rates were amounts per $m^2$ of light-sensitive material to be processed.

**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank wassupplied to Rinse (4) and the concentrated water was returned to Rinse (3). The pump pressure was adjusted so that an amount of the transmitted water to the reverse osmotic film module could be maintained at the rate of 50 to 300 ml per minute. A thermo-regulated circulation wascarried out for 10 hours a day. The rinse was made in a four-tanked counter-current system from (1) to (4). The tank capacity for each treating step is 400 ml. The continuous processing was performed over a day so that a color developing replenisher was to be half of the amount of the tank capacity.

The compositions of each of the processing solutions were as follows:

| | [Tank solution] | [Replenisher] |
|---|---|---|
| [Color developer] | | |
| Water | 800 ml | 800 ml |
| Fluorescent whitening agent (FL-1) | 2.2 g | 5.1 g |
| Fluorescent whitening agent (FL-2) | 0.35 g | 1.75 g |
| Tri(isopropanol)amine | 8.8 g | 8.8 g |
| Polyethyleneglycol (Molecular weight 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| 4,5-Dihydroxybenzene-1,3-disulfonic acid sodium salt | 0.50 g | 0.50 g |
| Disodium-N,N-bis(sulfonatoethyl) hydroxylamine | 8.5 g | 14.0 g |

-continued

| | [Tank solution] | [Replenisher] |
|---|---|---|
| 4-Amino-3-methyl-N-ethyl-N-(β-methanesulfonamidoethyl) aniline.3/2 sulfate.mono-hydrate | 4.8 g | 14.0 g |
| Potassium carbonate | 26.3 g | 26.3 g |
| Water to make | 1000 ml | 1000 ml |
| pH (at 25° C./adjusted with potassium hydroxide and sulfuric acid) | 10.15 | 12.40 |
| [Bleach - fixing solution] | | |
| Water | 800 ml | 800 ml |
| Ammonium thiosulfate (750 g/liter) | 107 ml | 214 ml |
| m-Carboxybenzenesulfinic acid | 8.3 g | 16.5 g |
| Ethylenediamine tetraacetic acid iron (III) ammonium salt | 47.0 g | 94.0 g |
| Ethylenediamine tetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (at 25° C./adjusted with nitric acid and aqua ammonia) | 6.5 | 6.5 |
| [Rinse solution] | | |
| Sodium chlorinated-isocyanurate | 0.02 g | 0.02 g |
| Deionized water (conductivity: 5 μs/cm or less) | 1000 ml | 1000 ml |
| PH (25° C.) | 6.5 | 6.5 |

The sample 101 was subjected to gradation exposure with blue light using an experimental processing device obtained by remodeling the above digital Mini-lab Frontier 350 (manufactured by Fuji Photo Film Co., Ltd.) and then subjected to a processing step A using a processing solution to carry out a continuous processing. After the processing, the density of yellow was measured on the sample 101 to obtain the characteristic curve corresponding to the blue sensitive layer. A density of an unexposed area in the characteristic curve (Dmin (Y)) was determined and then an exposure value (E) providing the density of Dmin+1.5 was obtained. Also, the processed sample 101 was additionally washed with running water at 40° C. for one hour and then dried, followed by measuring Dmin (Y)' of the dried sample.

The density of an unexposed area (Dmin (Y)), the exposure value (E), and Dmin (Y)' were obtained in the same way as one described above except that the samples 102 to 116 were used instead of the sample 101.

For making comparisons in sensitivity between the respective samples, the sensitivity of each sample was defined by a relative value of the value 1/E of each sample with the value 1/E of the sample 101 set as 100. When the sensitivity of the sample is higher than 100, it means that the sample has a higher sensitivity than that of the sample 101. When the sensitivity is less than 100, it means that the sample has a lower sensitivity than that of the sample 101. The smaller value of Dmin (Y), the less stains at the white background portions occur. In addition, for evaluating the color residue of the sample, ΔDmin was obtained by subtracting Dmin (Y)' from Dmin (Y) (i.e., Dmin (Y)−Dmin (Y)'). The smaller value of ΔDmin means that the amount of color residue is smaller. The compounds added to the emulsions in the first layers of the respective samples and the experimental results are listed in Table 2 below.

TABLE 2

| Sample No. | Sensitizing dye | Compound added | Sensitivity | Dmin (Y) | ΔDmin | Remarks |
|---|---|---|---|---|---|---|
| 101 | Dye-1 | None | 100 | 0.25 | 0.08 | Comparative ex. |
| 102 | Dye-1 | (1-Phenyl)-5-mercaptotetrazole | 77 | 0.15 | 0.07 | Comparative ex. |
| 103 | Dye-1 | Compound I-1 (n = 5 is a principal component.)* | 98 | 0.14 | 0.07 | Invention |
| 104 | S-38 | None | 131 | 0.31 | 0.03 | Comparative ex. |
| 105 | S-38 | (1-Phenyl)-5-mercaptotetrazole | 75 | 0.15 | 0.03 | Comparative ex. |
| 106 | S-38 | Compound I-1 (n = 5 is a principal component.)* | 130 | 0.11 | 0.03 | Invention |
| 107 | S-12 | None | 135 | 0.29 | 0.04 | Comparative ex. |
| 108 | S-12 | (1-Phenyl)-5-mercaptotetrazole | 65 | 0.15 | 0.03 | Comparative ex. |
| 109 | S-12 | p-Glutaramide phenyldisulfide | 70 | 0.19 | 0.05 | Comparative ex. |
| 110 | S-12 | Polyvinyl pyrrolidone** | 60 | 0.14 | 0.04 | Comparative ex. |
| 111 | S-12 | Compound I-1 (n = 5 is a principal component.)* | 134 | 0.12 | 0.03 | Invention |
| 112 | S-12 | Compound I-2 (n = 2 is a principal component.) | 130 | 0.13 | 0.03 | Invention |
| 113 | S-12 | Compound I-1 (n = 3 is a principal component.) | 133 | 0.12 | 0.02 | Invention |
| 114 | S-12 | Compound I-4 (n = 2 is a principal component.) | 130 | 0.12 | 0.03 | Invention |
| 115 | S-2 | None | 128 | 0.32 | 0.03 | Comparative ex. |
| 116 | S-2 | Compound I-1 (n = 5 is a principal component.)* | 126 | 0.13 | 0.03 | Invention |

*In Compound I-1 (n = 5), the terminal end $X_1$ is a hydroxyl group and $X_2$ is a 4-hydroxy-6-(2-hydroxyethyl) amino-1,3,5-triazin-2-yl group).
**An average molecular weight of polyvinyl pyrrolidone is about 630,000.

From Table 2, in the sample (the sample 102 relative to the sample 101) added with the compound for comparison, to which the present invention is not applied, it is found that the improvement in white background was attained by a decrease in Dmin (Y) but simultaneously the sensitivity of the sample was largely decreased. It is also found that the sample (the sample 103) in which the compound defined in the present invention was added to the emulsion was able to lower the value of Dmin (Y) without or with little decrease in sensitivity.

It is preferable that the samples (the samples 104, 107, and 115 relative to the sample 101) using sensitizing agents that has a smaller value of ΔDmin, i.e., allows less color residue, make the sensitivity higher. In this case, however, white background is deteriorated shown by Dmin (Y) increases even though the color residue is less than the other cases. It is found that samples (the samples 105, and 108 to 110) prepared by adding the compounds for comparison to which the present invention was not applied, to the samples using the sensitizing dyes with less color residue showed improvements in terms of Dmin (Y) but simultaneously a significant decrease in sensitivity occurred. In contrast, it is found that the samples (the samples 106, 111 to 114, and 116), in which the compounds defined in the present invention were respectively added, improved stains of the white background portions with almost no decrease in sensitivity.

Example 2

With respect to the sample 101 of Example 1, samples 201 to 216 were prepared by the same way as in the process of preparing each of emulsions B-H1 and B-L1 in the blue sensitive emulsion layer except that sensitizing dyes Dye-1, S-12, and S-38 were used in combination instead of the sensitive dye Dye-1, the amount of potassium iodide added was changed, and a mixture that contained a compound ($X_1$ was a hydroxyl group and $X_2$ was a 4-hydroxy-6-(2-hydroxyethyl)amino-1,3,5-triazin-2-yl group) having 3 to 8 repetitive units represented by the compound I-1 of the present invention and a compound having 2 to 3 repetitive units represented by the compound I-2 was added while varying the addition amount of the mixture.

Each sample was subjected to the following exposure and processing after a storage period of 7 days at a temperature of 25° C. and a relative humidity of 60% after coating the light-sensitive material and then the same evaluation as that of Example 1 was conducted.

(Exposure Conditions)

The exposure part of the digital Mini-lab Frontier 350 (manufactured by Fuji Photo Film Co., Ltd.) was remodeled so that exposure wavelength could be changed. As a blue light source, a blue semiconductor laser at a wavelength of about 440 nm (reported by Nichia Corporation in 48$^{th}$ Meeting of Japan Society of Applied Physics, in March 2001) was used. In addition, a green laser at about 530 nm obtained by wavelength conversion of a semiconductor laser (oscillation wavelength: about 1060 nm) by SHG crystals of $LiNbO_3$ having an inverted domain structure in the form of a waveguide, and a red semiconductor laser at a wavelength of about 650 nm (Hitachi type No. HL6501MG) were used. The laser beam emitted from each of those three-color lasers was shifted perpendicular to a scanning direction by reflecting on a polygonal mirror such that the beam could sequentially perform scanning exposure on the sample. The semiconductor laser was maintained at a constant temperature by means of a Peltier element to obviate light intensity variations associated with temperature variations. The laser beam had an effective diameter of 80 μm and a scanning pitch of 42.3 μm (600 dpi). In addition, an average exposure time per pixel was $1.7\times10^{-7}$ seconds.

(Processing Condition)

Processing B

| Processing Step | Temperature | Time | Replenishing rate* |
|---|---|---|---|
| Color Development | 45.0° C. | 17 sec. | 35 ml |
| Bleach-fixing | 40.0° C. | 17 sec. | 30 ml |
| Rinse (1) | 45.0° C. | 4 sec. | — |
| Rinse (2) | 45.0° C. | 4 sec. | — |
| Rinse (3)** | 45.0° C. | 3 sec. | — |
| Rinse (4)** | 45.0° C. | 5 sec. | 121 ml |
| Dry | 80° C. | 15 sec. | |

*The replenishment rates were amounts per $m^2$ of light-sensitive material to be processed.

**Rinse (3) was equipped with a rinse cleaning system RC50D (trade name) manufactured by Fuji Photo Film Co., Ltd., and a rinse solution was taken out from Rinse (3) and sent to a reverse osmotic film module (RC50D) by means of a pump. The permeated water obtained in the tank wassupplied to Rinse (4) and the concentrated water was returned to Rinse (3). The pump pressure was adjusted so that an amount of the transmitted water to the reverse osmotic film module could be maintained at the rate of 50 to 300 ml per minute. A thermo-regulated circulation wascarried out for 10 hours a day. The rinse was made in a four-tanked counter-current system from (1) to (4). The tank capacity for each treating step is 400 ml. The continuous processing was performed over a day so that a color developing replenisher was to be half of the amount of the tank capacity.

The compositions of each processing solutions are as follows.

| | [Tank solution] | [Replenisher] |
|---|---|---|
| [Color developer] | | |
| Water | 800 ml | 800 ml |
| Fluorescent whitening agent (FL-3) | 4.0 g | 8.0 g |
| Residual color-reducing agent (SR-1) | 3.0 g | 5.5 g |
| Triisopropanolamine | 8.8 g | 8.8 g |
| Sodium p-toluene sulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-Amino-3-methyl-N-ethyl-N-(β- | 7.0 g | 19.0 g |

-continued

| | [Tank solution] | [Replenisher] |
|---|---|---|
| methanesulfonamidoethyl) aniline.3/2 sulfate.mono-hydrate | | |
| Potassium carbonate | 26.3 g | 26.3 g |
| Water to make | 1000 ml | 1000 ml |
| pH (25° C./adjusted using sulfuric acid and potassium hydroxide) | 10.25 12.6 | |
| [Bleach-fixing solution] | | |
| Water | 800 ml | 800 ml |
| Ammonium thiosulfate (750 g/liter) | 107 ml | 214 ml |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C./adjusted using nitric acid and aqua ammonia) | 6.00 6.00 | |
| [Rinse solution] | | |
| Sodium chlorinated-isocyanurate | 0.02 g | 0.02 g |
| Deionized water (conductivity: 5 μS/cm or less) | 1000 ml | 1000 ml |
| PH (25° C.) | 6.5 6.5 | |

FL-1

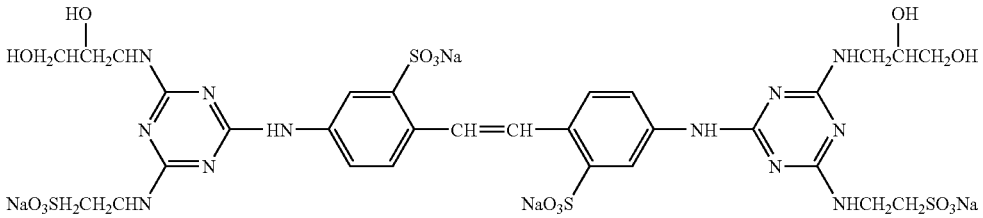

FL-2

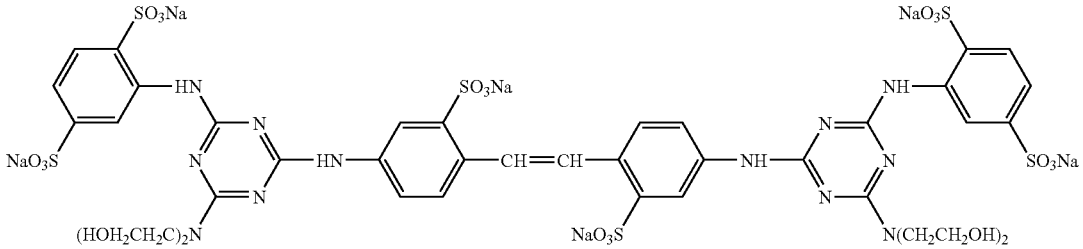

FL-3

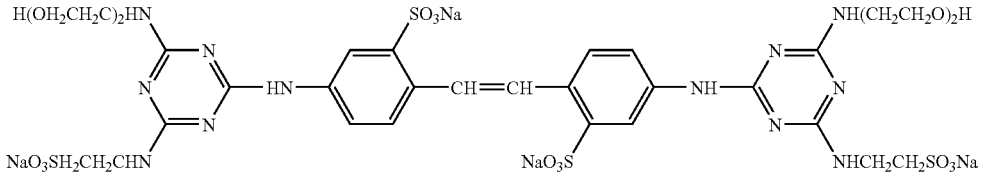

SR-1

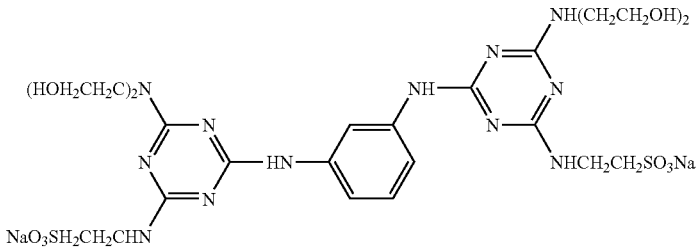

The iodide content in the first layer, the addition amount of the compound of the present invention, and the results of evaluation are listed in Table 3.

TABLE 3

| Sample No. | I (mole %) | Compound added* (mg)** | Sensitivity | Dmin(Y) | Remarks |
|---|---|---|---|---|---|
| 201 | 0.01 | None | 100 | 0.18 | Comparative example |
| 202 | 0.01 | 10 | 101 | 0.11 | Invention |
| 203 | 0.01 | 30 | 99 | 0.09 | Invention |
| 204 | 0.01 | 100 | 97 | 0.08 | Invention |
| 205 | 0.05 | None | 115 | 0.24 | Comparative example |
| 206 | 0.05 | 10 | 117 | 0.12 | Invention |
| 207 | 0.05 | 30 | 115 | 0.11 | Invention |
| 208 | 0.05 | 100 | 115 | 0.08 | Invention |
| 209 | 0.47 | None | 157 | 0.35 | Comparative example |
| 210 | 0.47 | 10 | 159 | 0.15 | Invention |
| 211 | 0.47 | 30 | 157 | 0.13 | Invention |
| 212 | 0.47 | 100 | 155 | 0.09 | Invention |
| 213 | 0.58 | None | 150 | 0.50 | Comparative example |
| 214 | 0.58 | 10 | 157 | 0.19 | Invention |
| 215 | 0.58 | 30 | 155 | 0.16 | Invention |
| 216 | 0.58 | 100 | 155 | 0.13 | Invention |

*A mixture containing Compound I-1 (n = 3 to 8, $X_1$ is a hydroxyl group and $X_2$ is a 4-hydroxy-6-(2-hydroxyethyl) amino-1,3,5-triazin-2-yl group) and Compound I-2 (n = 2 or 3).
**The addition amount per mol of silver halide in the first layer.

As is evident from Table 3, it is found that the improvement in whiteness at white background was attained with a negligible decrease in sensitivity by the addition of the compound defined in the present invention even though the iodide content was changed. In addition, when the iodide content was in the range of 0.02 to 0.5 mol %, it is found that both the sensitivity and the whiteness at white background portions were able to be favorably improved.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photosensitive material, comprising: at least one yellow-color-forming light-sensitive silver halide emulsion layer, at least one magenta-color-forming light-sensitive silver halide emulsion layer, and at least one cyan-color-forming light-sensitive silver halide emulsion layer on a reflective support; and at least one non-light-sensitive non-color-forming hydrophilic colloidal layer, wherein at least one of the photosensitive silver halide emulsion layers contains a silver halide emulsion that contains 90 mol % or more of silver chloride; and a compound having a repetitive unit represented by the following formula (I) is contained:

Formula (I)

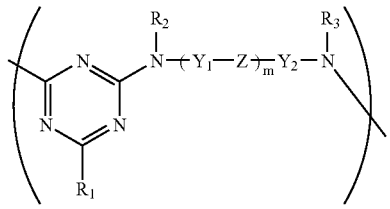

wherein $R_1$ represents —OR, —SR, or —N—R(—R'), in which R and R' each independently represent a hydrogen atom, or an alkyl group, an aryl group, an aralkyl group, a cycloalkyl group, or a heterocyclic group, which may be further substituted, or R and R' may bond together to form a saturated carbon ring or a heterocycle constructed of an alkylene group including —O—; $R_2$ and $R_3$ each independently represent a hydrogen atom or an alkyl group which may be further substituted; $Y_1$ and $Y_2$ each independently represent a polymethylene group, an arylene group, or a cycloalkylene group, which may be further substituted; Z represents —O—, —$SO_2$—, or —$CH_2$—; and m represents 0 (zero) or 1.

2. The silver halide color photosensitive material as claimed in claim 1, in which the yellow-color-forming light-sensitive silver halide emulsion layer contains a silver halide emulsion which is spectrally sensitized by at least one sensitizing dye represented by the following formula (II):

Formula (II)

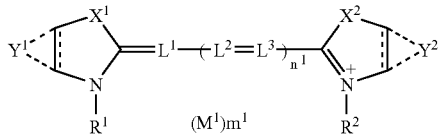

wherein $X^1$ and $X^2$ each independently represent an oxygen atom, a sulfur atom, a selenium atom, a tellurium atom, a nitrogen atom, or a carbon atom; $Y^1$ represents an atomic group necessary for forming a furan, pyrrole, thiophene, or benzene ring, which may be further condensed with another 5- or 6-membered carbon ring or heterocycle or may have a substituent; $Y^2$ represents an atomic group necessary for forming a benzene ring or a 5- or 6-membered unsaturated heterocycle, which may be further condensed with another 5- or 6-membered carbon ring or heterocycle or may have a substituent; a bond between two carbon atoms by which $Y^1$ and $Y^2$ are each condensed with the carbon ring or the heterocycle may be a single bond or a double bond; one of $R^1$ and $R^2$ represents an alkyl group substituted with an acidic group except a sulfo group and the other of $R^1$ and $R^2$ represents an alkyl group substituted with a sulfo group; $L^1$, $L^2$, and $L^3$ each independently represent a methine group; $n^1$ represents 0 (zero) or 1; $M^1$ represents a counter ion; and $m^1$ represents 0 (zero) or a larger number, which is necessary for neutralizing an electric charge in the molecule.

3. The silver halide color photosensitive material as claimed in claim 2, wherein $n^1$ in the formula (II) is 0 (zero).

4. The silver halide color photosensitive material as claimed in claim 2, in which the sensitizing dye represented by the formula (II) is represented by the following formula (III) or (IV):

Formula (III)

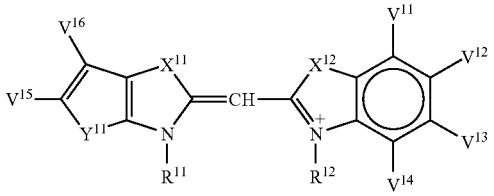

$(M^{11})m^{11}$ wherein $Y^{11}$ represents an oxygen atom, a sulfur atom, or N—$R^{13}$, in which $R^{13}$ represents a hydrogen atom or an alkyl group; $V^{15}$ and $V^{16}$ each independently represent a hydrogen atom or a substituent; $X^{11}$ and $X^{12}$ each independently represent an oxygen atom or a sulfur atom; one of $R^{11}$ and $R^{12}$ represents an alkyl group substituted with an acidic group except a sulfo group and the other of $R^{11}$ and $R^{12}$ represents an alkyl group substituted with a sulfo group; $V^{11}$, $V^{12}$, $V^{13}$, and $V^{14}$ each independently represent a hydrogen atom or a substituent; $M^{11}$ represents a counter ion; and $m^{11}$ represents 0 (zero) or a larger number, which is necessary for neutralizing an electric charge in the molecule;

Formula (IV)

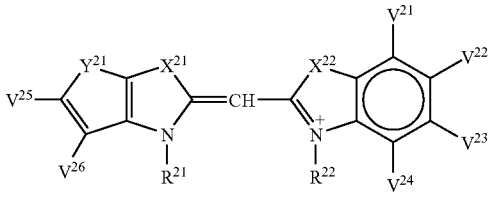

$(M^{21})m^{21}$ wherein $Y^{21}$ represents an oxygen atom, sulfur atom, or N—$R^{23}$; in which $R^{23}$ represents a hydrogen atom or an alkyl group; $V^{25}$ and $V^{26}$ each independently represent a hydrogen atom or a substituent; $X^{21}$ and $X^{22}$ each independently represent an oxygen atom or a sulfur atom; one of $R^{21}$ and $R^{22}$ represents an alkyl group substituted with an acidic group except a sulfo group and the other of $R^{21}$ and $R^{22}$ represents an alkyl group substituted with a sulfo group; $V^{21}$, $V^{22}$, $V^{23}$, and $V^{24}$ each independently represent a hydrogen atom or a substituent; $M^{21}$ represents a counter ion; and $m^{21}$ represents 0 (zero) or a larger number, which is necessary for neutralizing an electric charge in the molecule.

5. The silver halide color photosensitive material as claimed in claim 2, in which the sensitizing dye represented by the formula (II) is represented by the following formula (V):

Formula (V)

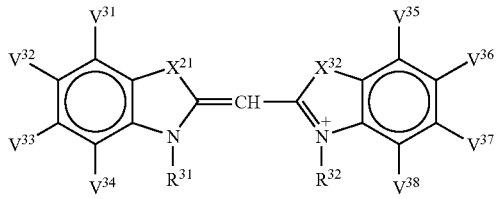

$(M^{31})m^{31}$ wherein $X^{31}$ and $X^{32}$ each independently represent an oxygen atom or a sulfur atom; one of $R^{31}$ and $R^{32}$ represents an alkyl group substituted with an acidic group except a sulfo group and the other of $R^{31}$ and $R^{32}$ represents an alkyl group substituted with a sulfo group; $V^{31}$, $V^{32}$, $V^{33}$, $V^{34}$, $V^{35}$, $V^{36}$, $V^{37}$, and $V^{38}$ each independently represent a hydrogen atom or a substituent, in which two adjacent substituents may bond together to form a condensed ring; $M^{31}$ represents a counter ion; and $m^{31}$ represents 0 (zero) or a larger number, which is necessary for neutralizing an electric charge in the molecule.

6. The silver halide color photosensitive material as claimed in claim 1, in which the silver halide emulsion contained in the yellow-color-forming light-sensitive silver halide emulsion layer contains silver iodide at a concentration of 0.02 to 0.5 mol %.

7. The silver halide color photosensitive material as claimed in claim 1, in which the silver halide emulsion contained in the yellow-color-forming light-sensitive silver halide emulsion layer is composed of crystal grains having a cubic or tetradecahedral structure having a cubic grain volume corresponding to 0.55 μm or less in side length.

8. The silver halide color photosensitive material as claimed in claim 1, in which the total amount of silver applied on photographic constituent layers is 0.2 $g/m^2$ or more and 0.46 $g/m^2$ or less.

9. A method of forming a color image, comprising, after exposure, subjecting the silver halide color photosensitive material as claimed in claim 1 to color development for 20 seconds or less.

10. The silver halide color photosensitive material as claimed in claim 1, wherein the compound has two or more repetitive units represented by formula (I).

11. The silver halide color photosensitive material as claimed in claim 1, wherein the compound has two or more but twenty or less repetitive units represented by formula (I).

* * * * *